US007600731B2

(12) United States Patent
Pasto

(10) Patent No.: US 7,600,731 B2
(45) Date of Patent: Oct. 13, 2009

(54) FOLDING TELESCOPIC STABILIZATION RESCUE STRUT WITH OVEREXTENSION PREVENTION

(75) Inventor: Cris E. Pasto, Spencer, NY (US)

(73) Assignee: Res-Q-Jack, Inc., Elmira, NY (US)

( * ) Notice: Subject to any disclaimer, the term of this patent is extended or adjusted under 35 U.S.C. 154(b) by 534 days.

(21) Appl. No.: 11/115,733

(22) Filed: Apr. 27, 2005

(65) Prior Publication Data

US 2005/0258332 A1 Nov. 24, 2005

Related U.S. Application Data

(63) Continuation-in-part of application No. 10/720,997, filed on Nov. 24, 2003, now Pat. No. 7,338,025, which is a continuation-in-part of application No. 09/982, 368, filed on Oct. 18, 2001, now Pat. No. 6,772,984.

(60) Provisional application No. 60/565,619, filed on Apr. 27, 2004.

(51) Int. Cl.
*A47F 5/00* (2006.01)

(52) U.S. Cl. ..... 248/352; 248/354.5; 254/45

(58) Field of Classification Search ..... 248/352, 248/354.5, 354.1, 163.2; 280/763.1, 764.1, 280/765.1, 766.1, 762; 72/705; 254/45, 254/426, 133 R, 133 A, DIG. 14
See application file for complete search history.

(56) References Cited

U.S. PATENT DOCUMENTS

| | | | | |
|---|---|---|---|---|
| 1,188,330 A | | 6/1916 | Schaefer | |
| 1,705,625 A | | 3/1929 | Mitchell | |
| 2,630,296 A | | 3/1953 | Lucker | |
| 2,725,210 A | * | 11/1955 | Swartz | 248/354.3 |
| 3,003,645 A | | 10/1961 | Sanders | 211/86 |
| 3,171,627 A | * | 3/1965 | Tapley et al. | 248/354.3 |
| 3,235,296 A | | 2/1966 | Day | 287/58 |
| 3,866,619 A | | 2/1975 | Per Frisk | 135/15 |
| 3,899,110 A | | 8/1975 | Binging et al. | 224/42.1 |
| 4,111,217 A | | 9/1978 | Victor | 135/114 |
| 4,198,847 A | | 4/1980 | Russell et al. | |
| 4,296,905 A | | 10/1981 | Powell | 248/237 |
| 4,801,117 A | | 1/1989 | Take | 248/237 |
| 4,840,340 A | | 6/1989 | Gustafsson et al. | 248/240.4 |
| 5,011,176 A | | 4/1991 | Eppinette | 280/479.3 |
| 5,056,753 A | | 10/1991 | Lunau et al. | |
| 5,322,315 A | | 6/1994 | Carsten | 280/479.2 |
| 5,520,030 A | | 5/1996 | Muldoon | |
| 5,660,495 A | | 8/1997 | Atsukawa | 403/377 |
| 5,797,226 A | | 8/1998 | MacKarvich | |

(Continued)

*Primary Examiner*—Gwendolyn Baxter
(74) *Attorney, Agent, or Firm*—Thomas T. Aquilla

(57) ABSTRACT

A folding telescopic buttress stand includes a first two-piece telescopic section having an outer tubing member and an inner tubing member in slidable engagement, the outer tubing member being pivotally attached at its lower end to a base plate, and the inner tubing member having attached at its upper end a second two-piece telescopic section having an outer tubing member and an inner tubing member in slidable engagement. One embodiment includes an end fitting or adapter for engagement with a vehicle or other object affixed to the upper end of the inner tubing member. Yet another embodiment includes a third two-piece telescopic section having an outer tubing member and an inner tubing member in slidable engagement affixed to the upper end of the second two-piece telescopic section.

5 Claims, 29 Drawing Sheets

U.S. PATENT DOCUMENTS 5,845,921 A 12/1998 Stimac ..... 280/479.3
6,017,170 A 1/2000 Michalo ..... 405/272
6,158,705 A 12/2000 Cudmore et al. ..... 248/354.1
6,234,440 B1 5/2001 Boney et al.
6,776,383 B2 8/2004 Lanka

* cited by examiner

FOLDING TELESCOPIC STABILIZATION RESCUE STRUT WITH OVEREXTENSION PREVENTION

REFERENCE TO RELATED APPLICATIONS

This is a continuation-in-part patent application of application Ser. No. 10/720,997, filed Nov. 24, 2003 now U.S. Pat. No. 7,338,025, entitled "METHOD AND APPARATUS FOR BUTTRESS STABILIZATION", which is a continuation-in-part patent application of Ser. No. 09/982,368, filed Oct. 18, 2001, entitled "METHOD AND APPARATUS FOR BUTTRESS STABILIZATION", now issued as U.S. Pat. No. 6,772,984. The aforementioned applications are hereby incorporated herein by reference in their entireties. This application claims an invention, which was disclosed in Provisional Application No. 60/565,619, filed Apr. 27, 2004, entitled "IMPROVED RESCUE TOOLS". The benefit under 35 USC § 119(e) of the United States provisional application is hereby claimed, and the aforementioned provisional application is hereby incorporated herein by reference in its entirety.

BACKGROUND OF THE INVENTION

1. Field of the Invention

The invention pertains to the field of emergency rescue. More particularly, the invention pertains to methods and apparatus for stabilizing a roof-resting motor vehicle, such as for access by rescue workers, and for extracting accident victims from the vehicles.

2. Description of Related Art

A roof-resting motor vehicle can be a difficult situation for rescue teams, particularly in terms of vehicle stabilization. In any vehicle stabilization effort, quick and simple solutions are desired; time spent on vehicle stabilization is time not spent on victim extrication and patient care. However, what often is overlooked is that most of the known quick and simple techniques for stabilizing a roof-resting vehicle interfere with access to the passenger compartment. Many of these techniques Include the step of attaching restraint straps to the rear posts of the vehicle, or running straps across the door up to the undercarriage of the vehicle, thus limiting accident victim extrication options.

Another problem inherent in the stabilization of a roof-resting vehicle is that the locations most desired to place stabilization stands typically are the least conducive to a good purchase. For example, in many situations, the engine weight of the vehicle keeps the nose down and the rear end up, leaving a sloped slippery surface with little for a prop tip to engage. The rear of a typical sedan, for example, provides very few solid locations for stand engagement. Examples of areas that typically lend themselves to purchase include fender light knockouts in fenders, gas fill openings, rear trunk walls, tail light knockouts, and some bumpers or bumper supports. Often one can punch out the rear fender lights, thus leaving a hole in the fender as a purchase point.

Depending on vehicle condition, because of the collision, the presence of rust, and/or vehicle material composition, one may be able to gain a purchase sufficient to remove "play" in the vehicle. However, if vertical support is necessary, this could be a problem with sheet metal or plastic materials, particularly if the fenders provide the only available purchase. If one opens the gas fill door, one may find a good purchase there. Unfortunately, a gas fill door typically is available only on one side of the vehicle (although some models of vehicles have them on two sides, but this is a rare exception). Furthermore, if fuel is leaking, this will have to be addressed also, as setting the metal stand against a metal fender could possibly cause ignition.

The rear trunk wall usually provides a good grip for a channel-type end fitting. However, gaining access to the trunk wall often is difficult, unless the trunk lid is removed. Bumpers are another typical option, but come in many shapes and materials. Some are strong, some are weak. Bumper supports vary considerably as well. One technique, which is very quick to employ, is to place a single stand centered in the rear of the vehicle, in conjunction with step blocking or wedges in front of the 'A' posts. This provides three points of stabilization. However, two of the points, the wedges, are low relative to the center of gravity of the vehicle, and do little to increase the vehicle footprint.

Note that a roof-resting vehicle has a much lower center of gravity in comparison with a side-resting vehicle, as well as a wider footprint to start with. The use of wedges does, however, increase good solid ground contact. An advantage to this type of system is that the prop purchase is typically a solid one with the rear trunk wall or a solid bumper, and the base is well restrained. However, there are several disadvantages with this type of system. To restrain the base properly, the straps typically are hooked at either the rear posts, or run up the sides to the vehicle undercarriage. Attaching to the rear posts can in some situations cause difficulty in roof removal. Further, straps that run up the sides in front of the doors limit access from the sides. In addition, the stand itself is centered in the rear of the vehicle, thus hampering access to the rear window.

Another known method is to apply a stand at each fender, again preferably with wedges in front of the 'A' post. With a good purchase, this can be sufficient stabilization in some cases. With this system, the base strap of one stand is connected to the opposite stand base. Disadvantages with this system include the purchase difficulties mentioned above, and the fact that the bases are not restrained completely. If the vehicle can be restrained from sliding, the lack of sideward base restraint most likely will not be an issue. An advantage to this system is that the passenger compartment is left relatively unobstructed.

Another known technique is to combine the previous two methods, thus providing a stand at both rear fenders and a stand at the rear center, along with the wedge cribbing at the 'A' post. Restraint straps can be configured in a few different ways. One strapping configuration is to strap the fender stand bases to each other independent of the rear stand, and to strap the rear stand base to the rear roof posts using 'J' hooks. Another method is to strap the rear stand to the fender stands, and then strap the fender stands to the rear post. In addition, the fender stands may be strapped to each other. In this configuration, the straps connected to the rear posts can be moved to the front of the vehicle, thus leaving the passenger compartment unobstructed. The final strap configuration noted above keeps extrication options open, however, the difficulty of finding quick and solid stand engagement remains a problem.

During a vehicle rescue situation, it is often necessary to remove the doors and/or roof of the vehicle to gain access and free patients. When the car is resting normally on its wheels, this is a simple operation with few concerns of any problems. However, when the car is resting on its roof, complete roof and door removal may lead to a failure, bending, or collapse of the floor pan which could injure the occupants and/or rescue team. One known technique for preventing such a problem is to place support stands or cribbing from the ground up to the floor pan of the vehicle, supporting the area from which the doors were removed. One problem with this approach, however, is that the support components cannot be placed until the vehicle parts (doors and/or roof) have been removed. This typically allows for a short time period with no support, which could potentially lead to a collapse. Another problem with the prior supporting technique is that it places equipment in the way of patient access and removal.

U.S. Pat. No. 6,017,170, "Adjustable Self Locking Shoring Strut", and U.S. Pat. No. 6,158,705, "Vehicle Stabilization and Support Tool" disclose examples of prior art shoring struts, which could be used with the methods of the present invention, if the prior art struts were equipped with appropriately designed end fittings (which are not shown in the patents). However, neither patent discloses a method similar to the methods of the present invention. U.S. Pat No. 6,158,705, for example, suggests tying the base of a support tool to the vehicle, but uses only one strut and does not discuss where the strap should be attached.

Space on rescue vehicles generally is quite limited, due to the nature of the field and the large variety of equipment required to handle various rescue operations. Stabilization and/or shoring stands typically consume substantial space on rescue vehicles. Telescopic stabilization stands are known in the art and allow for some space conservation relative to long 4×4 wooden shores. Also, a two-piece telescopic stand can be deployed more quickly than a three-piece telescopic stand, because there is only one pin to disengage and re-set with a two-piece stand. To extend a three-piece telescopic stand, the user must pull two pins in order to extend any section. This often results in some confusion, particularly in a hectic rescue situation, which adds additional time to the deployment. Additionally, due to availability of materials, a three-piece telescopic stand may involve a small cross section at its inner most piece, which may limit the safe working load. However, a two-piece stand with similar extension capabilities consumes more space than a three-piece telescopic stand.

U.S. Pat. No. 4,840,340 discloses a telescopic brace assembly for supporting a work surface, which can be folded relative to a frame structure, that includes two tubes which are capable of being moved telescopically, one within the other, and the mutually opposite free ends of which are intended to be pivotally connected to a respective one of the objects. Arranged within the telescopic tubes is a spring, which biases the tubes together.

U.S. Pat. No. 4,801,117 discloses a portable support boom for window washers provided on a support frame, which has extendable boom sections that can be folded into a collapsed position, and includes transporting wheels and handles so that the boom can be manually rolled from one place to another.

U.S. Pat. No. 4,296,905 discloses a building scaffold support including one or more elongated base members arranged to lie on the top surface of a building with their outer end portions projecting beyond the side of the building. The base members have a depending arm connected to the outer end portion thereof, and a scaffold for workmen is arranged to be suspended from such arms by suitable suspension lines or the like.

U.S. Pat. No. 4,111,217 discloses an arctic tent pole, which includes two or more pole sections hingedly interconnected by a hinge permitting the support to be folded for storage purposes. At least one of the pole sections has a pair of portions disposed in telescopic relation for sliding movement providing a fast coarse adjustment to the length of the support. The sliding movement is lockable at various relative positions by a quick release coupling which, upon locking the sliding telescopic movement, converts to a screw thread fine adjustment for changing the length of the support.

U.S. Pat No. 3,899,110 discloses a foldable car top carrier. U.S. Pat No. 3,003,645 discloses an iron support and clothes rack assembly for an ironing board. U.S. Pat. No. 1,188,330 discloses a folding tent pole.

Telescopic stands typically consist of an outer tube and one or more inner tubes nested within each other. If such stands are to be used under an axial load, an adequate overlap between successive tubes is desired to prevent failure. Known means of accomplishing this include painted sections near the ends of nested sections to alert the user not to extend past the painted portions. An advantage to this method is that the ability to completely disassemble the stand is preserved. A disadvantage is that it requires the user to pay close attention, while extending the stand. Another positive means includes the use of stop collars attached to the ends of the inner and outer sections. The advantage with this system is that over-extension is not possible. Disadvantages include cost and complexity in manufacturing, and the inability to quickly disassemble for user modifications, etc. Additionally, stop collars require space within the tubing sections, which would otherwise be occupied by successively smaller sizes. This requires that the outer tube be larger than the outer tube of a stand with no stop collars to maintain a similar inner tube dimension, and thus a similar working load capacity.

U.S. Pat. No. 5,845,921 discloses a trailer hitch that has a plurality of longitudinally tapered, telescoping members movable between a retracted position substantially contained within a largest of the telescoping members and an extended position in which at least one of the plurality of telescoping members is extendible from the largest member so as to be three-dimensionally adjustable.

U.S. Pat No. 5,660,495 discloses a locking-unlocking mechanism which is capable of realizing firm and reliable connection between pipes when a plurality of pipes telescopically arranged are extended, and capable of disconnecting the connected pipes rapidly and precisely.

U.S. Pat. No. 5,322,315 discloses a towing hitch for coupling a towing vehicle with a vehicle which is to be towed is provided which includes a body having a pocket within which a receiver tube is pivotally mounted. The receiver tube telescopically mounts a tow bar which is configured for selected operative securement to a vehicle which is to be towed.

U.S. Pat No. 5,011,176 discloses a coupling device for connecting a towed vehicle to a towing vehicle in which the towed vehicle has a towing bar. There is a telescopic arm received within the towing bar with an end of the telescopic arm pivotally connected to an articulating arm. The other end of the articulating arm has mounted to it a trailer hitch adapted for connection to a trailer hitch ball. There is an anti-pivot collar which encircles the point where the telescopic arm and the articulating arm are pivotally connected.

U.S. Pat. No. 3,866,619 discloses a unitary pole system comprising at least two telescopically arranged tube members having a strap affixed to the inside of the tube members to hold them together. U.S. Pat No. 3,235,296 extensible and retractable implement handle having a cord affixed to a gaff inside the handle to hold the elements together. U.S. Pat. No. 1,705,625 discloses an extensible rod.

Prior art telescopic buttress stabilization stands require additional time and manpower to extend, and take up substantial space upon storage. However, rescue situations typically demand speedy results and rescue vehicles require compact equipment. Additionally, space and manpower often are limited. Therefore, known telescopic buttress stabilization stands suffer from various drawbacks and thus an improved telescopic buttress stabilization stand is needed in the art.

SUMMARY OF THE INVENTION

The present invention provides methods and apparatus for stabilizing a roof-resting motor vehicle, which are useful for emergency rescue workers who must stabilize a damaged vehicle and assist in removing the accident victims. More particularly, the invention provides methods and apparatus for universal stand engagement at fenders, independent of vehicle construction, material, and design, and further provides for keeping patient access free from obstruction, leaving all possible extrication options available. The invention provides solid vehicle stabilization, is simple to understand, and quick to set up.

According to a preferred aspect of the present invention, herein is disclosed an improved method for stabilizing a roof-resting vehicle, which includes the steps of leaning one or more buttress stands, each preferably having chain-grab end fittings or other suitable attaching means, against a fender area of the vehicle, passing a chain or other suitable fastening means under an end of the vehicle from one of the buttress stands to another (if more than one stand is used), with slack extending up to the vehicle's undercarriage on each side of the vehicle, tightening the slack from the chain or other suitable fastening means by pulling the chain-grab end fittings or other suitable attaching means towards the fenders at the vehicle undercarriage or lower side of the vehicle, using a ratchet strap or similar tightening means, optionally restraining the chain or other suitable fastening means from sliding off the end of the vehicle by attaching a ratchet strap or similar tightening means to the chain or other suitable fastening means near the vehicle, and passing the chain or other suitable fastening means up to the vehicle undercarriage in front of a wheel assembly of the vehicle, attaching a ratchet strap or similar tightening means at a base of the one or more buttress stands and tightening, and optionally placing wedges in front of each roof support post, such that the vehicle is stabilized.

An advantage of the present invention is that it provides quick, simple means for stabilizing a vehicle, requires no search for prop purchase, and leaves the passenger compartment free from obstruction, thereby keeping multiple access options open for rescue personnel.

According to another preferred aspect of the present invention, herein is disclosed a folding telescopic buttress stand including a first two-piece telescopic section having an outer tubing member and an inner tubing member in slidable engagement, the outer tubing member being pivotally attached at its lower end to a base plate, and the inner tubing member having attached at its upper end a second two-piece telescopic section having an outer tubing member and an inner tubing member in slidable engagement.

According to yet another preferred aspect of the present invention, herein is disclosed an alternative embodiment including an end fitting or adapter for engagement with a vehicle or other object affixed to the upper end of the inner tubing member. Yet another embodiment includes a third two-piece telescopic section having an outer tubing member and an inner tubing member in slidable engagement affixed to the upper end of the second two-piece telescopic section.

These and other features and advantages will become readily apparent from the following Detailed Description, which should be read in conjunction with the accompanying drawings.

BRIEF DESCRIPTION OF THE DRAWING

FIG. 8*a* shows an embodiment of a chain-grab end fitting according to the

DETAILED DESCRIPTION OF THE INVENTION

Figure 1:
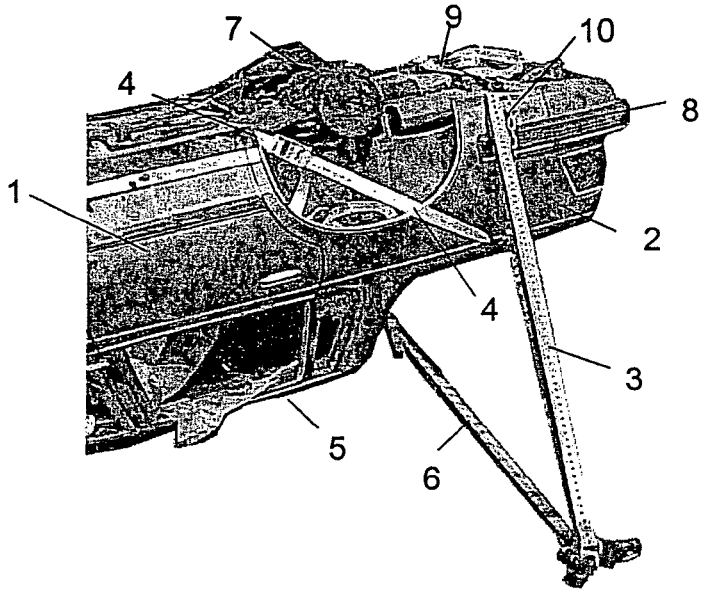
FIG. 1 shows a side view of a vehicle stabilized by one embodiment according to the invention.
Figure 2:
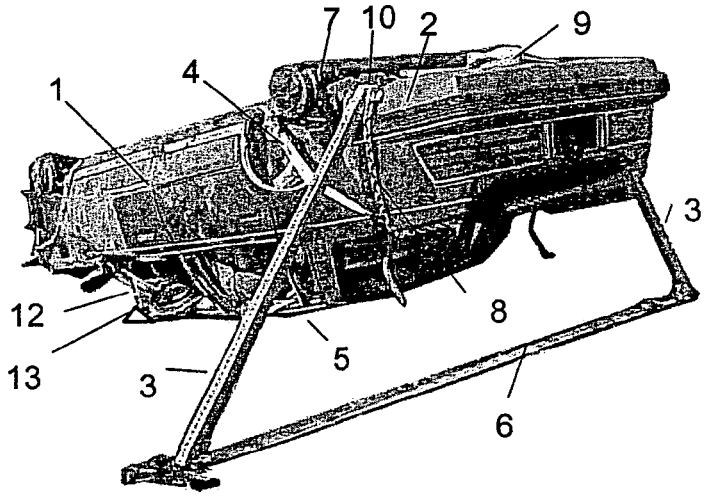
FIG. 2 shows a rear quarter view of a vehicle stabilized by an embodiment according to the invention.
Figure 3:
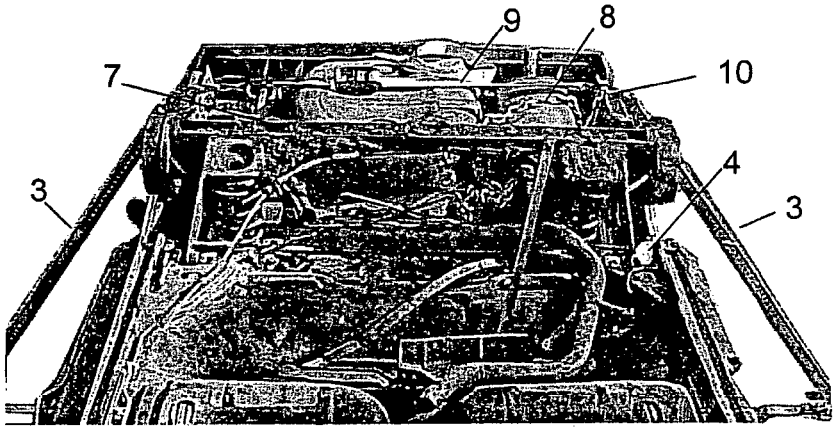
FIG. 3 shows a view of the undercarriage of a vehicle stabilized by an embodiment according to the invention.
Figure 4:
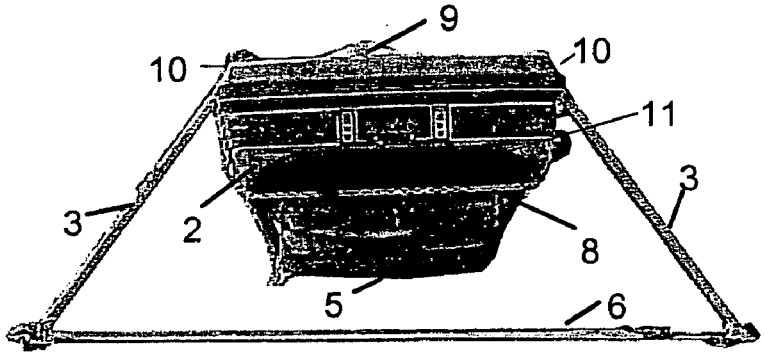
FIG. 4 shows a rear view of a vehicle stabilized by an embodiment according to the invention.
Figure 5:
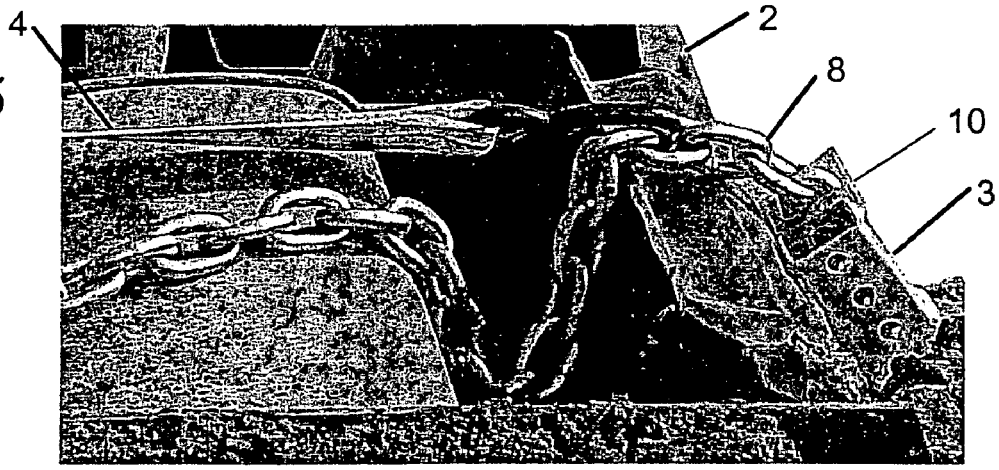
FIG. 5 shows a detail view of the undercarriage of a vehicle stabilized by an embodiment according to the invention.
Figure 6:
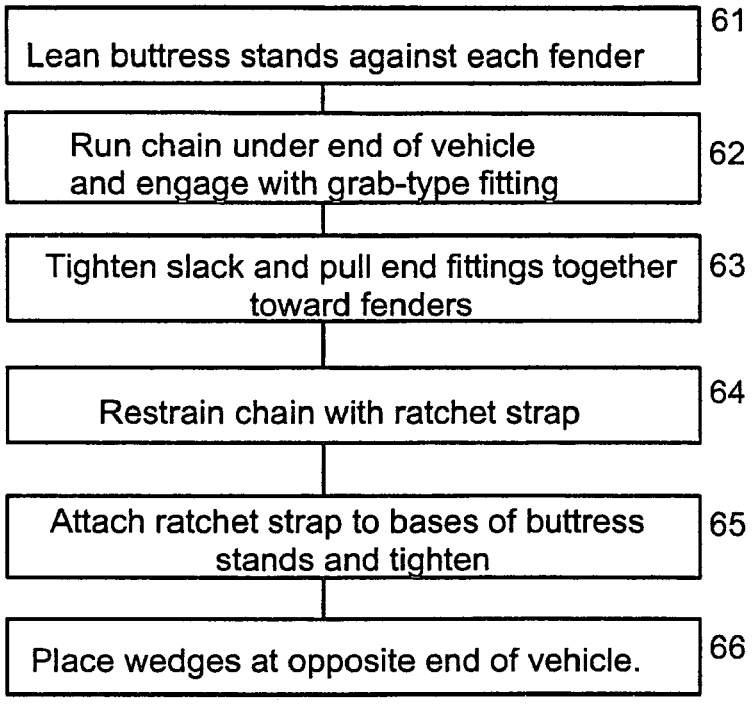
FIG. 6 shows a flowchart of the method of an embodiment according to the invention.

As detailed in the flowchart of FIG. 6, and as shown in FIGS. 1 through 5 and 10 through 12, an embodiment of the present invention involves generally the following steps:

(61) lean buttress stands (3) preferably with special chain grab end fittings (10) preferably against each fender (2) on an end of the vehicle (1), with the bases spaced outward from the vehicle to form a stable angle.

Figure 10:
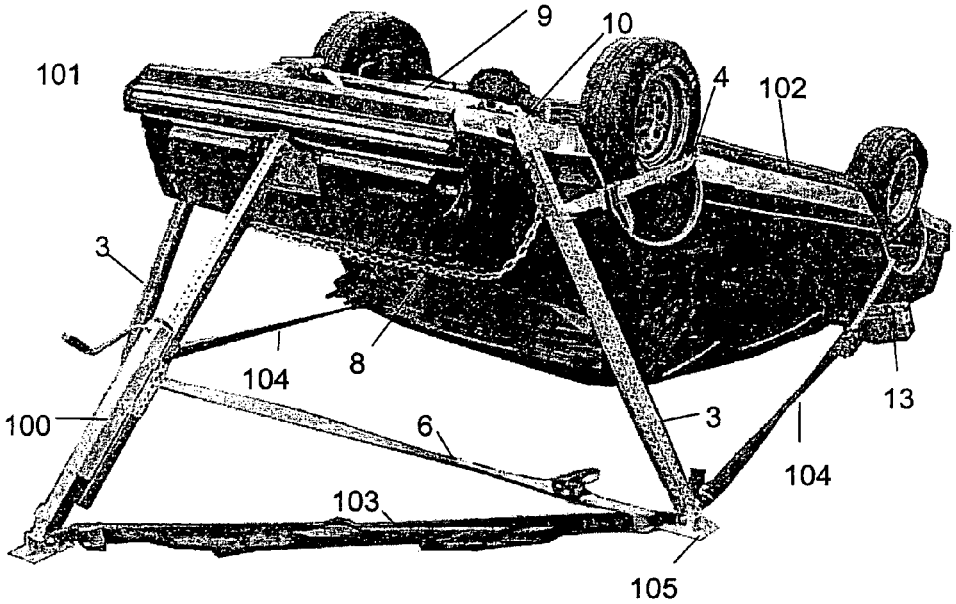
FIG. 10 shows a vehicle stabilized by an embodiment according to the invention, using three buttresses.
Figure 14:
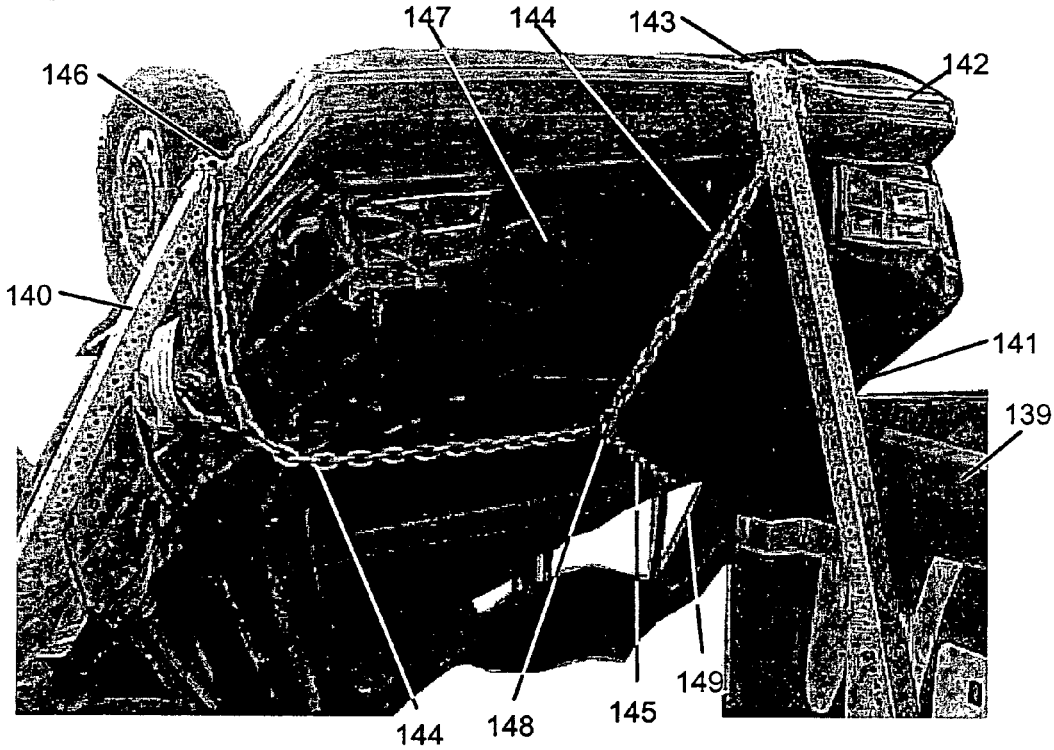
FIG. 14 shows an alternative embodiment according to the invention, using a tensioned and restrained chain.

Stand, buttress, strut, adjustable stand, cribbing post, post, and jack stand may be used interchangeably to describe the rigid member extending from the vehicle down and outward to the ground. The stands optionally are adjustable on fixed increments, such as jack stands, or include a lifting means, or consist simply of timber posts, for example. This member may be of a fixed length, although the length is preferably adjustable. The buttresses (3) in FIGS. 14 and 11, and jack-type buttresses (120) in FIG. 12 or (100) in FIG. 10 are all adjustable, either by pinned telescopic sections or the same combined with a jack. The member length may be adjusted by various means: manually, mechanically, pneumatically, electrically, or otherwise—as, for example, by jack handle (121) shown in FIG. 12. Depending on the adjustment method of the particular buttress, the length may or may not be adjusted under a loaded condition—a jack, for instance, can be adjusted in length while under load, while a buttress with pinned holes would not. While the stands shown are all adjustable length, stands may be of fixed length as well constructed of timber, metal, etc.

Figure 11:
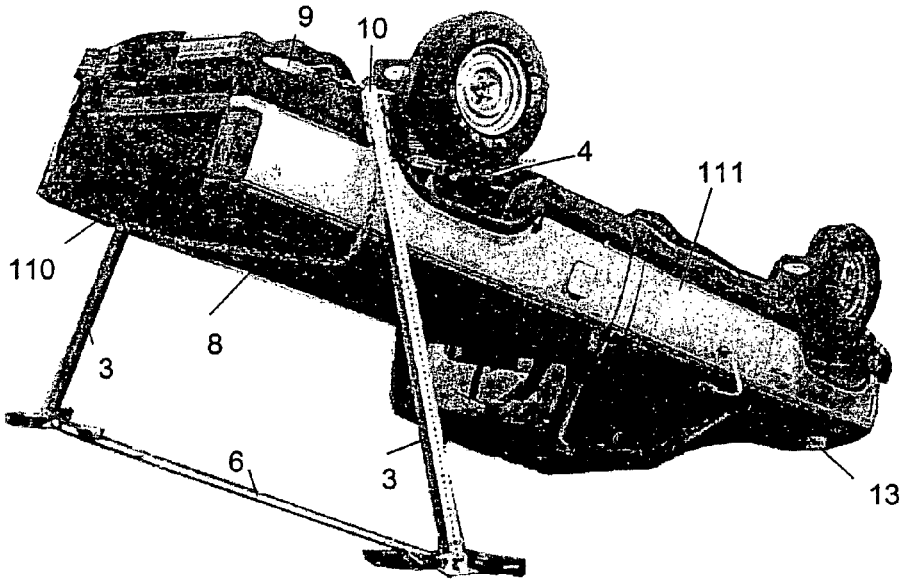
FIG. 11 shows an embodiment according to the invention used with a pickup-truck type vehicle.
Figure 12:
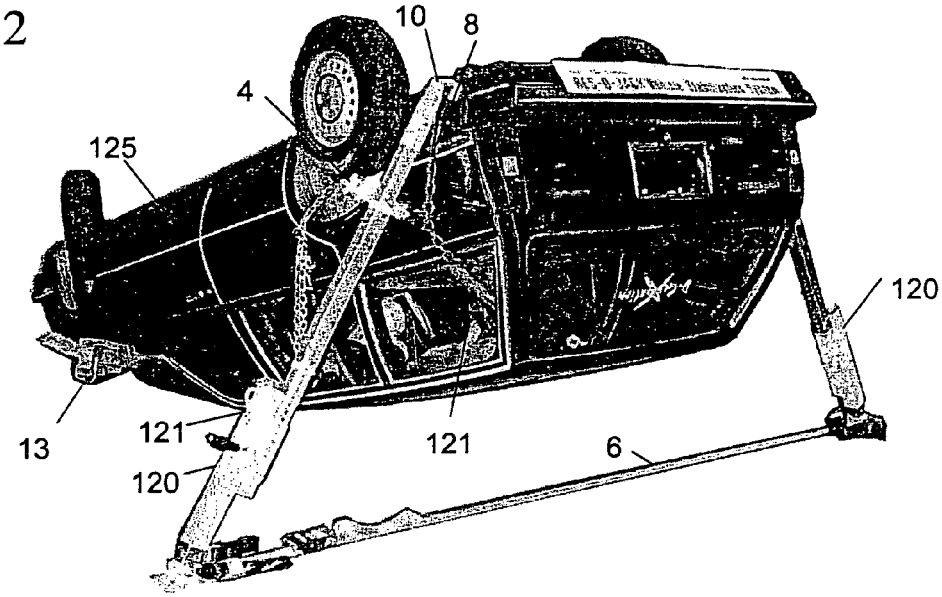
FIG. 12 shows a hatchback-type vehicle stabilized by an embodiment according to the invention, using jack-type buttress stands.

Note that while this method might normally be used at the rear end of the vehicle, as shown in the figures, because of the tendency of the weight of the engine to pull the front of the vehicle down, it will be understood that the method of the invention is equally applicable to situations where the front end of the vehicle needs to be stabilized and the trunk is down, with other types of vehicles such as the pickup truck shown in FIG. 11 or the hatchback of FIG. 12, or convertibles or tractors which do not have roofs, or where the vehicle is in other positions than resting on its roof, as perhaps on its side.

Figure 8A:
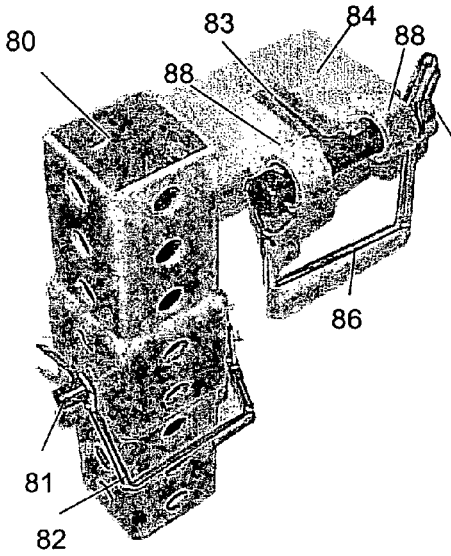
Figure 8B:
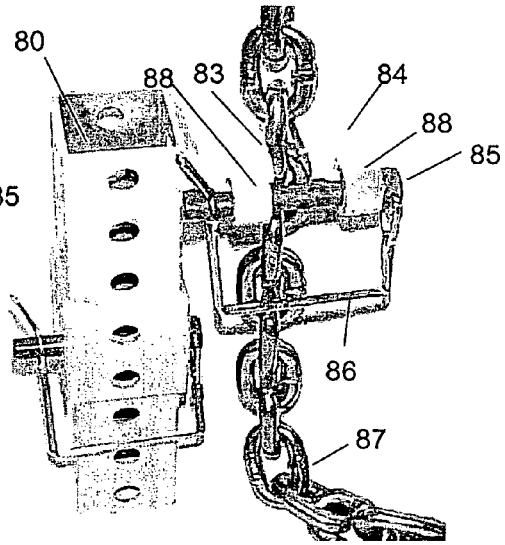
FIG. 8*b* shows an embodiment of the chain-grab end fitting of FIG. 8*a*, with a chain engaged.
Figure 8C:
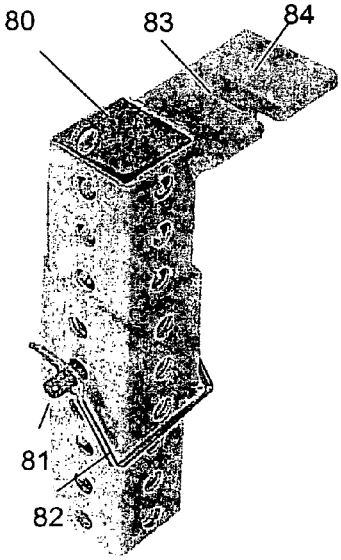
FIG. 8*c* shows another embodiment of a chain-grab end fitting according to the present invention.

FIGS. 8*a*, 8*b* and 8*c* show an embodiment of a chain-grab end fitting (10) which would be suitable for use with the method of the invention. The end fitting body (80) fits within the end of the buttress stand, and is held in place by a pin (81) which runs through holes in the body (80) and stand. Provision of a number of holes permits a range of length adjustment of the buttress stand. A keeper (82) prevents the pin (81) from pulling out inadvertently. A grab plate (84) is attached to the body (80), and has a slot (83) into which a link of chain (87) can fit. Since the slot (83) is only the width of the link of chain, the next link will wedge against the plate (84) and hold the chain in place. In the variation shown in FIGS. 8*a* and 8*b*, a stopper pin (85) is slipped into loops (88) and secured with keeper (86), to keep the chain (87) from slipping out of the slot (83). FIG. 8*c* shows a simpler variation which omits the pin (85) and loops (88).

Figure 9:
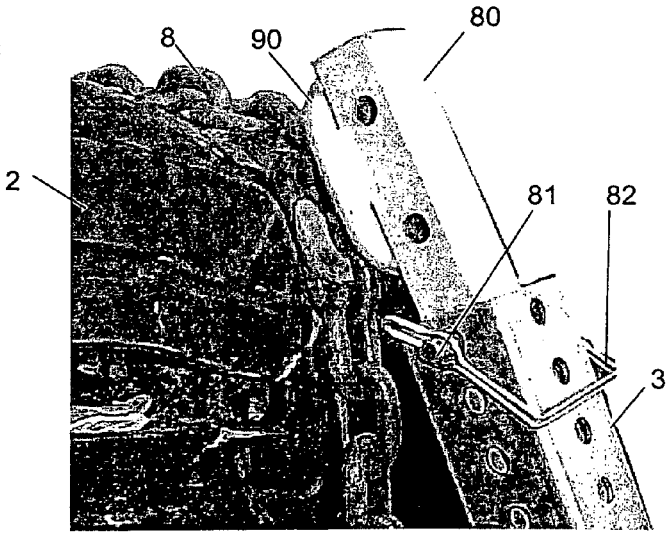
FIG. 9 shows still another embodiment of a chain-grab end fitting, in use on a stabilized vehicle.

FIG. 9 shows another embodiment of the chain-grab end fitting, in use engaging a chain (8) against a vehicle fender (2). Like the other embodiments shown in FIGS. 8*a*-8*c*, it has a body (80) secured to the buttress stand (3) by pin (81), held in by keeper (82). In this embodiment, the chain (8) is held by a split chain link (90) welded to the body (80). The chain (8) is hooked by the split link (90) and thereby secured against the tension.

Figure 13:
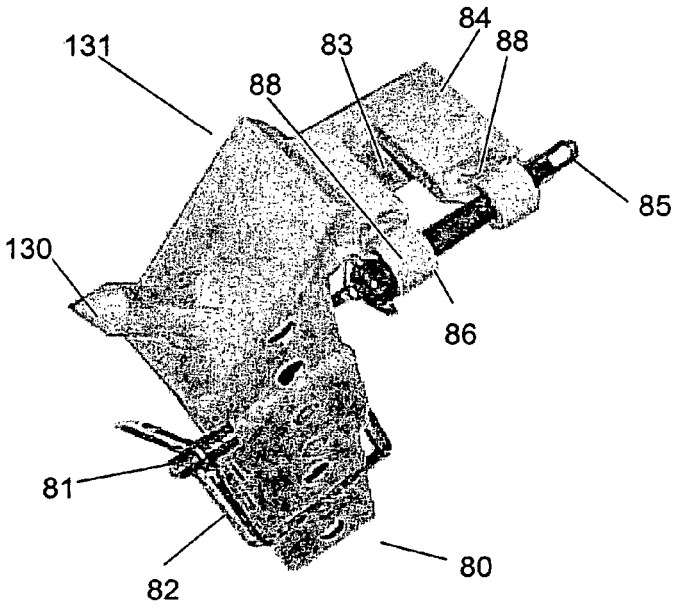
FIG. 13 shows an alternative embodiment of a chain-grab end fitting according to the invention, combined with another fitting.

FIG. 13 shows yet another embodiment of the chain-grab end fitting, combined with another type fitting having a round-point fitting (130) on an angled plate (131). The round-point fitting can be inserted into factory knockouts in vehicle frames, bolt holes, or other openings when the stand is used in other applications. The round-point fitting could also be a channel, chisel point, angle, etc.—whatever other function might be desired to be combined with the chain-grab end fitting. The other elements of the chain-grab end fitting are as discussed above.

(62) run chain (8) from one end fitting to the other under the end (hood or trunk lid (11), or pickup truck bed (110) of the vehicle (1) from one stand (3) to the other with slack extending up to undercarriage (7) on each side. If necessary, as shown in FIG. 12 with a hatchback vehicle (125), it may be necessary to break out the side windows (121) and run the chain (8) through the cargo area. The same would be true of sports-utility vehicles (SUVs), station wagons, vans or other similar vehicles, which have a roof extending to the rear of the vehicle and no horizontal rear deck or trunk.

It will be recognized by one skilled in the art that most modern vehicles lack classic fenders as that term traditionally is defined, however, the terms "fender" and "fender area" are used herein to describe generally a side body panel of a vehicle, which typically is located near the wheels and may include, for example, fenders, wheel wells, cutouts, as well as other similar structures.

Note that in the context of the invention the term "chain" is meant to encompass literal chains, as well as straps, ropes, cables, slings, wires, etc.—the terms are used interchangeably to refer to a flexible or semi-flexible tie member which may be attached to two or more points;

(63) tighten slack and pull end fittings (10) to fender (2) using a ratchet strap (9) from one end of chain (8) to other end of chain at undercarriage (7).

Note that the term "ratchet strap" is meant to include any adjustable-length flexible member, such as straps with ratchet adjusters, as well as locking straps, "come-alongs", turnbuckle straps or chains, or other similar arrangements. The length of the flexible member may be adjusted between said points to cause a change in the tension in that member by means of a cam-buckle, ratchet, binder, turnbuckle, come-along, or similar device for tightening.

(64) restrain chain (8) from sliding off end of vehicle by attaching a ratchet strap (4) to chain (8) near the trunk lid (11) or other horizontal surface such as a pickup truck (111) cap or bed (110) in FIG. 11, (or the hood, if the front end of the vehicle is being stabilized) and running up to undercarriage (7) in front of wheel assembly (swing-arm pivot point may be suitable).

With a typical sedan it is preferred to place the stands and straps/chains on both sides to be sure the chain cannot slip over the rear of the vehicle at any location. However, with an SUV, hatchback, or wagon type vehicle you have a roof post at the very back of the vehicle. If you break the windows and pass through here with the chain there may be no need to use the above referenced tie members on either side unless vehicle condition requires it. I recommend it always be done on both sides as a practice such that it becomes a standard procedure that will not be left out when needed, however, technically it can be done on both sides or one side only.

(65) restrain bases from sliding in all directions by any means or combination thereof. For example, attach a ratchet strap (6) to bases of buttress stands (3) and tighten, or alternatively, for example, stake each base to the ground; and (66) if needed, place wedges (13) or similar in front of each roof support post at the opposite end of the vehicle ("A" pillar (12) or hood or front of roof, if the rear is raised, or rearmost pillar, if the front is raised).

In practice, execution of the above steps takes only about two minutes to accomplish. There is little thinking required in terms of deciding how to set the stands, how to gain purchase with the vehicle, or how to keep stabilization from interference with patient access/extrication.

If a third stand is desired at the rear center of the vehicle, it optionally can be added at any time, as shown in FIG. 10, where a jack-type stand (100) is used to support the bumper (101) of car (102). In this case, straps (103) may be attached from the third stand (100) to the bases (105) of the fender stands (3).

Also note in FIG. 10 the additional straps (104) running from the bases (105) of fender stands (3) to the opposite (front) end of the car (102). This configuration would keep the passenger compartment free from strap attachment.

A situation could arise where one side of the vehicle is otherwise supported either because obstructions demand a different support on that side or the way the vehicle came to rest provided that support. The chain could still be wrapped around in the same fashion, and a stand applied at only one side. The base of this stand could be attached to an object on the opposite side of the vehicle. Alternately, if the stand were a jack stand which is capable of self-tightening, the base of the stand could be "picketed" or staked in place or otherwise prohibited from movement by a strap or other means.

Figure 7:
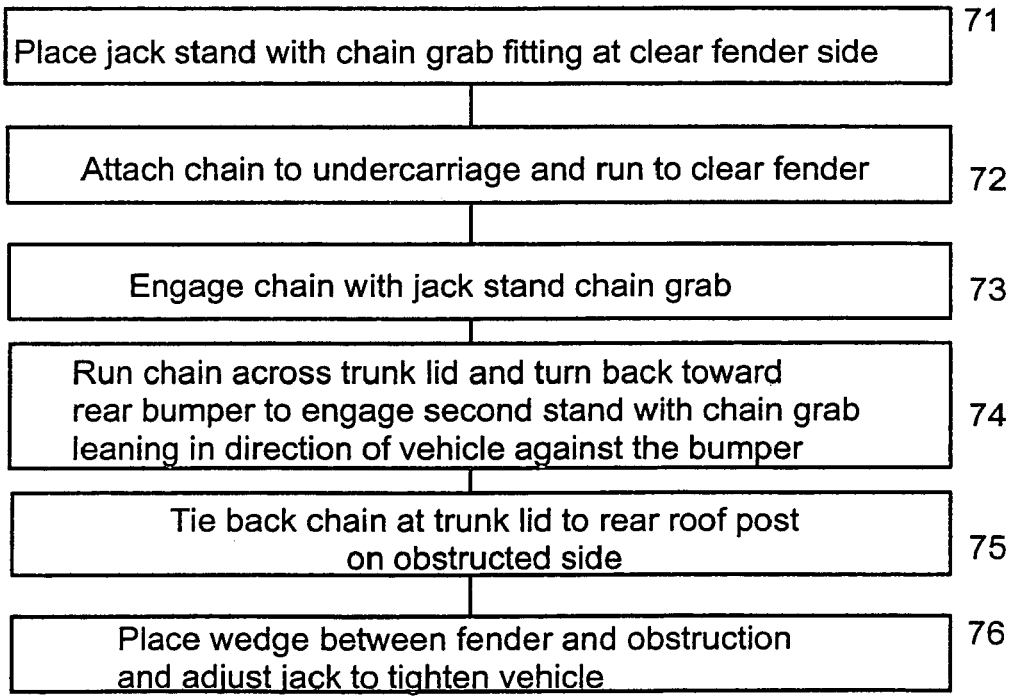
FIG. 7 shows a flowchart of an alternative embodiment according to the invention.

There are other possibilities—wherever one can place a tight chain, one can place a stand with a chain grab end fitting. For example, assuming a car is resting on its roof beside an obstruction (e.g., a building or other object, such as the dumpster (139) shown in FIG. 14), which would prevent placing a stand at one of the fenders. The other fender is clear. The bumper stand (141) offers vertical support. It may be a jack stand staked to the ground and adjusted to tighten, or an adjustable stand with ratchet strap for tightening. Here is how it would be set up (referring to the flowchart of FIG. 7, and the view of FIG. 14):

(71) place a jack stand with chain grab fitting (140) at clear fender side.

(72) attach chain (144) to undercarriage and run towards clear fender.

(73) engage chain with jack stand (140) chain grab (146).

(74) run chain (144) across trunk lid (147) and turn back towards rear bumper (142) to engage second stand (141) with chain grab (143) leaning in direction of vehicle against the bumper (142).

(75) tie the center of the chain back to the rear roof post (149) on the obstructed side with a second chain or strap (145), creating a corner (148) in the chain (144) on the trunk lid (147).

(76) place a wedge between car fender and obstruction and adjust jack of step (71) to tighten vehicle against obstruction.

Figure 15:
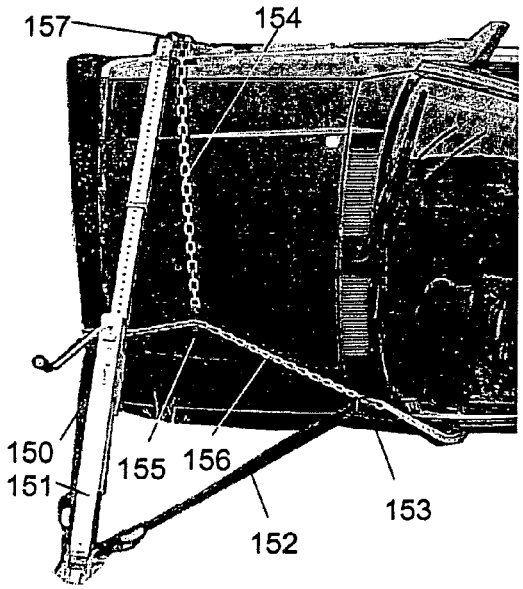
FIG. 15 shows an alternative embodiment according to the invention, with a single stand on one side of the vehicle.

Alternately, if the obstruction does not prevent a full wrap of the chain around the tail end (or front end), the chain could be placed and a loop possibly taken off of it. FIG. 15 shows a car supported in this fashion, which is another application of a restrained and tensioned chain. The "chain" here refers to the chain (156) we wrap around the tail end of a vehicle and restrain in our preferred technique described in FIG. 6. This chain would serve as a foundation from which to build. For example, another chain (154) could be attached to this restrained chain (156) with hook (155). The new chain (154) could come up and attach to the stand (151) at the chain grab end fitting (157). Note that the chains (154)(156) serve as purchase for not only the end fitting (157) but also the straps (150)(152)—the latter attaching to chain (156) at hook (153).

Figure 16:
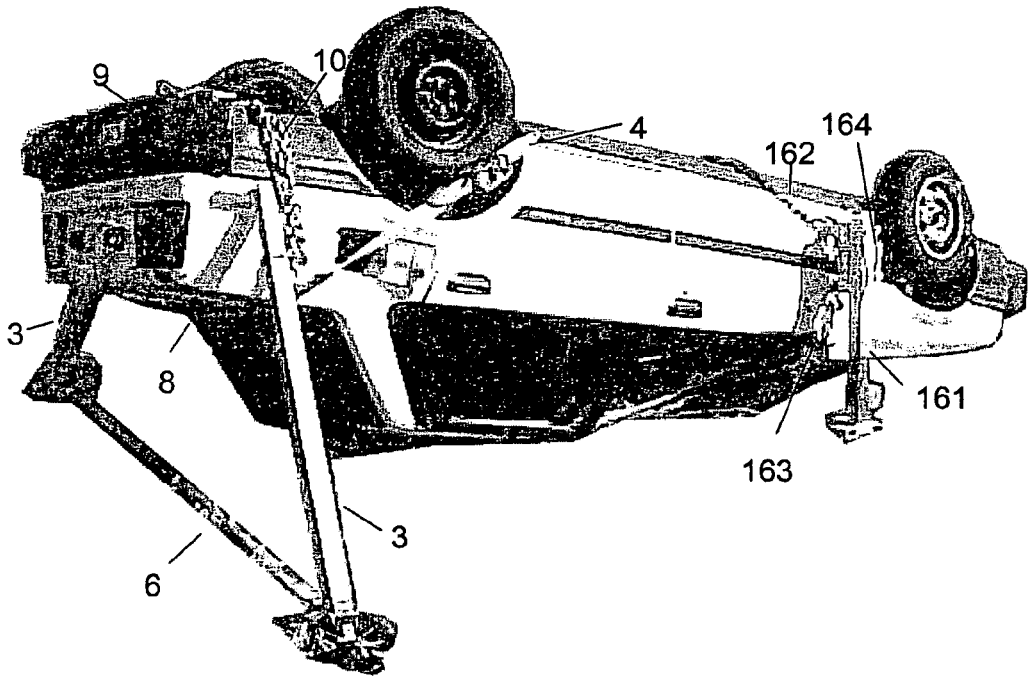
FIG. 16 shows a vehicle stabilized by an embodiment according to the invention, with a jack used to lift the vehicle to free an occupant.

FIG. 16 shows a jack (161) to be used along with a chain grab fitting (164) and chain (162)(163) to perform low-level lifts of objects. In this configuration, the device may be useful in lifting a roof-resting car off the ground to free a patient trapped beneath, in lieu of setting up air lift bags.

Our research in the area of buttress stabilization of a roof-resting vehicle has led to improvements as well as alternative methods, which in many cases simplify and quicken the stabilization process. We have discovered through such research that, while the foregoing methods are a great improvement over any prior means, there are improved derivatives of the technique, which are equally valuable in saving time and producing a stable working environment.

Figure 17:
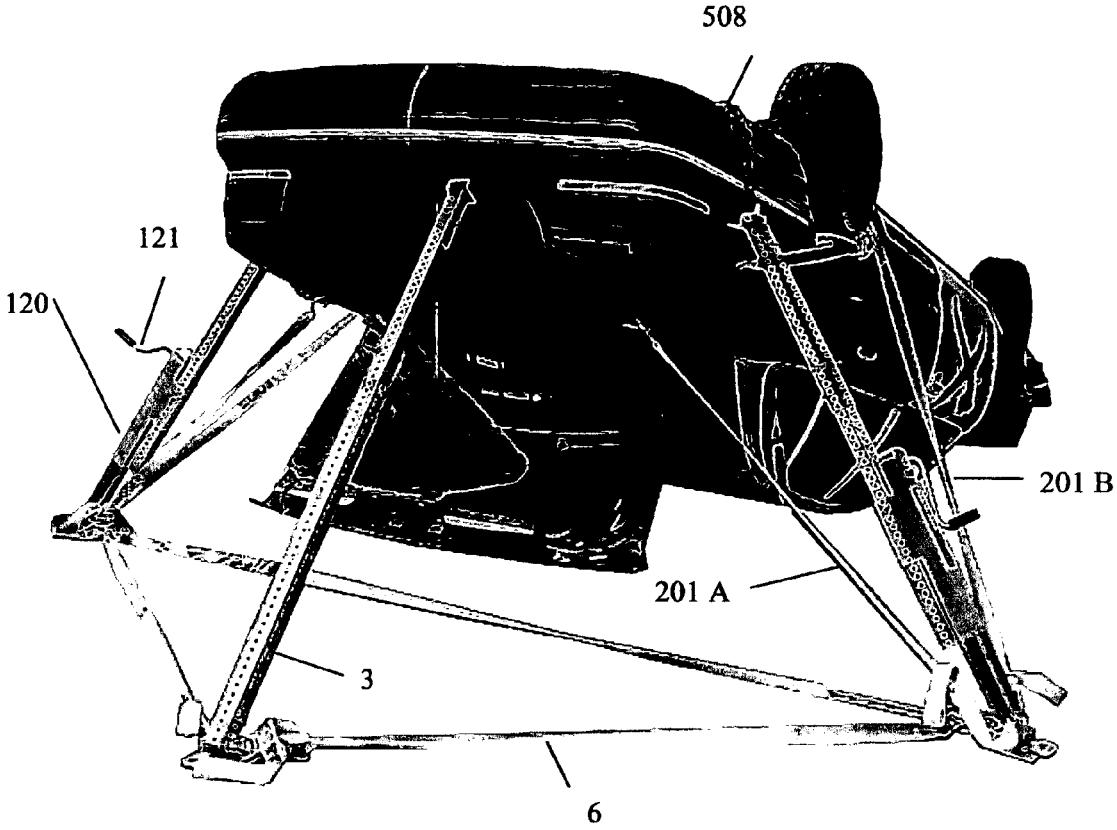
FIG. 17 shows an alternative embodiment according to the invention, including the additional step of adding sway straps.

Referring now to FIG. 17, one improvement is the addition of two more flexible members (201A, 201B) or "sway straps" attached from the base of the stand (3) up to the chain saddle (508). The need for these two members arises when lifting of the vehicle is involved. When the vehicle is left unelevated from its roof-resting positions, typically the standard method provides adequate stability. However, once the vehicle is elevated, the vehicle may be less stable, because the shape created by the two stands, the vehicle and the base-to-base strap (6) is a trapezoid. Such a shape is inherently unstable. This allows for the ability of the vehicle to sway with the potential for it to cause further complications. Adding the extra sway strap (201A, 201B) at each base, from the base up to the chain at the fender/trunk corner, in effect creates a triangle at each side of the vehicle, thus eliminating or at least decreasing the amount of freedom the vehicle has to sway.

Figure 18:
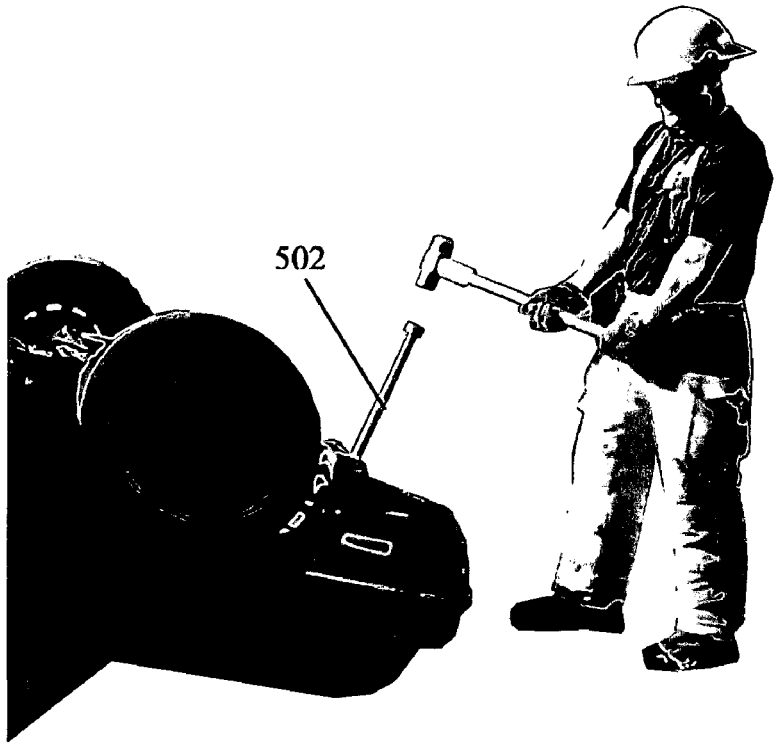
FIG. 18 shows an alternative embodiment according to the invention, including the additional step of staking the hood.

Referring now to FIG. 18, another unique concept in the area of roof-resting vehicle stabilization is the method of "staking" the hood of the vehicle to the ground to prevent front to back movement of the vehicle. This new technique decreases the amount of equipment required and greatly speeds up the process. The method involves placing a stake through the engine compartment and driving the stake (502) through the vehicle hood area into the ground.

We have developed several alternate methods of creating a chain or similar flexible member type purchase with a roof-resting vehicle for the purpose of buttress stabilization. These include the Rear Post Chain Wrap method, J-Hooking the Rear Post, J-Hooking the Side-Wall, and J-Hooking the Rear Deck, each of which is described below in detail.

While the figures and description herein show attachment of the chain to the rear post for the purpose of illustration of the methods, the invention contemplates alternatively attachments to other posts, such as a front or middle post.

Figure 19:
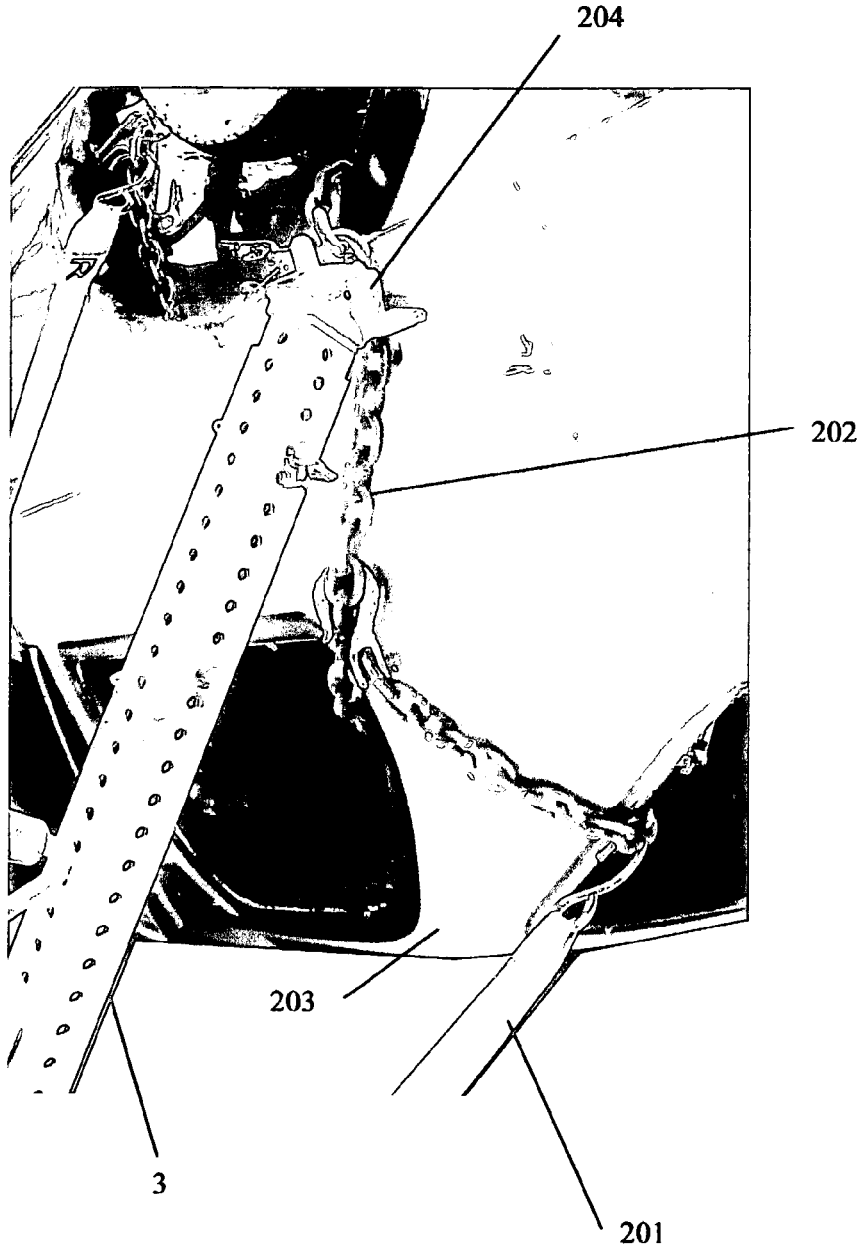
FIG. 19 shows an alternative embodiment according to the invention, including the rear post chain wrap step.

Referring now to FIG. 19, one alternative method is to wrap a chain (202) around a roof post, preferably the rear-most post (203) like a noose and bringing one end of the chain up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass across the trunk lid of a sedan type vehicle, thus allowing trunk access. This method also eliminates the need for a chain saddle to pass across the rear window of a hatchback, which is often a critical patient access point. This method also involves far fewer components than the standard method. It preferably involves the two buttress stands with chain grab type end fittings, the base to base restraint chain or strap, as well as a chain wrap at each post which can be accomplished using a single chain. If lifting or additional stability is desired, one may incorporate the two optional sway prevention straps (201).

Figure 20:
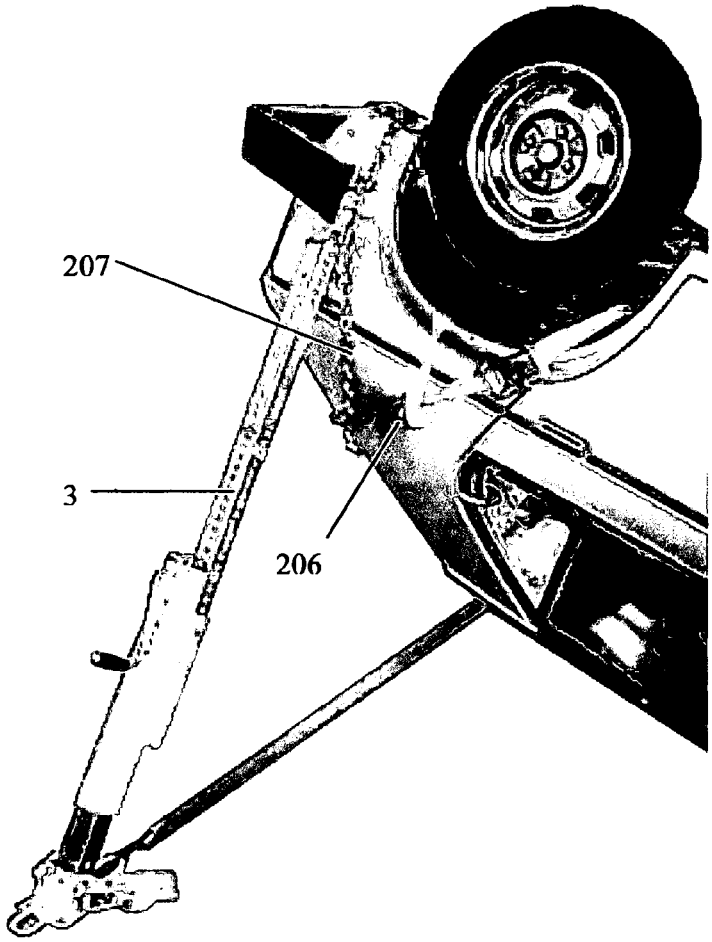
FIG. 20 shows an alternative embodiment according to the invention, including the step of J-hooking the rear post.

Referring now to FIG. 20, another alternative method is to enter through the rear window (not shown in FIG. 20) of an inverted vehicle and attach a large J-hook (206) to the post. Alternatively, one can pass through a side window and attach to any post. A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass across the trunk lid of a sedan type vehicle, thus allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Figure 21:
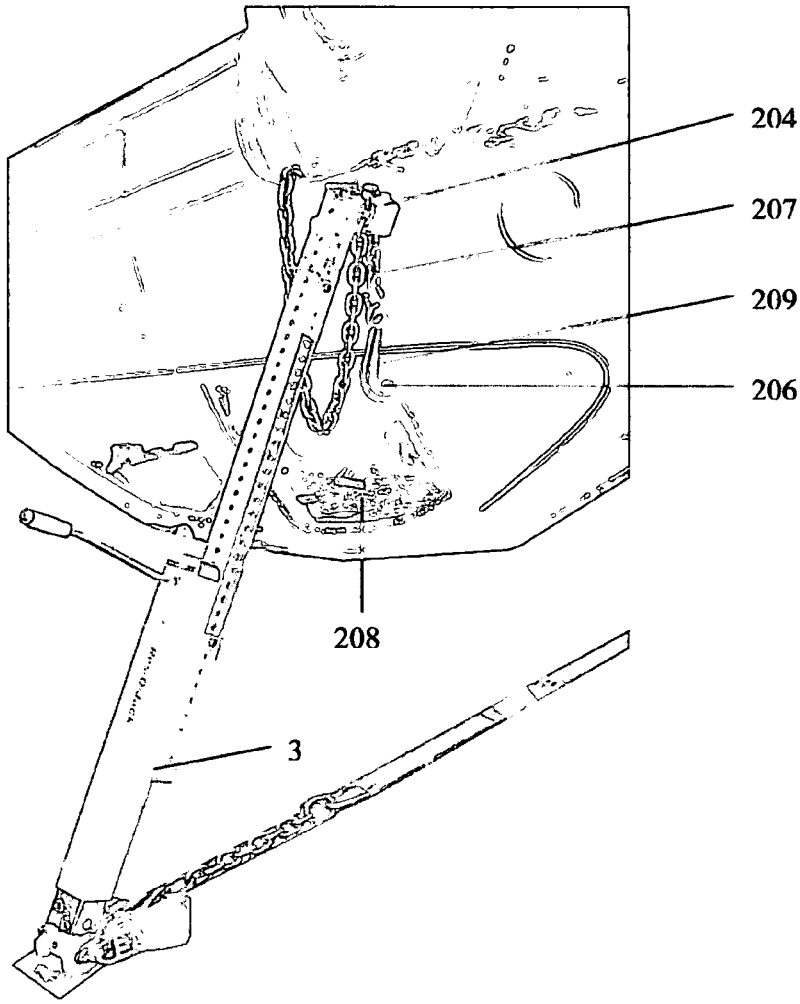
FIG. 21 shows an alternative embodiment according to the invention, including the step of J-hooking the sidewall.

Referring now to FIG. 21, another alternative method is to enter through the side window (208) of an inverted vehicle and attach a large J-hook (206) to the sidewall (209). A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass through the passenger compartment of an SUV, minivan, or wagon vehicle. This method also eliminates the need for a chain saddle to pass across the trunk lid of a sedan type vehicle, allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Figure 22:
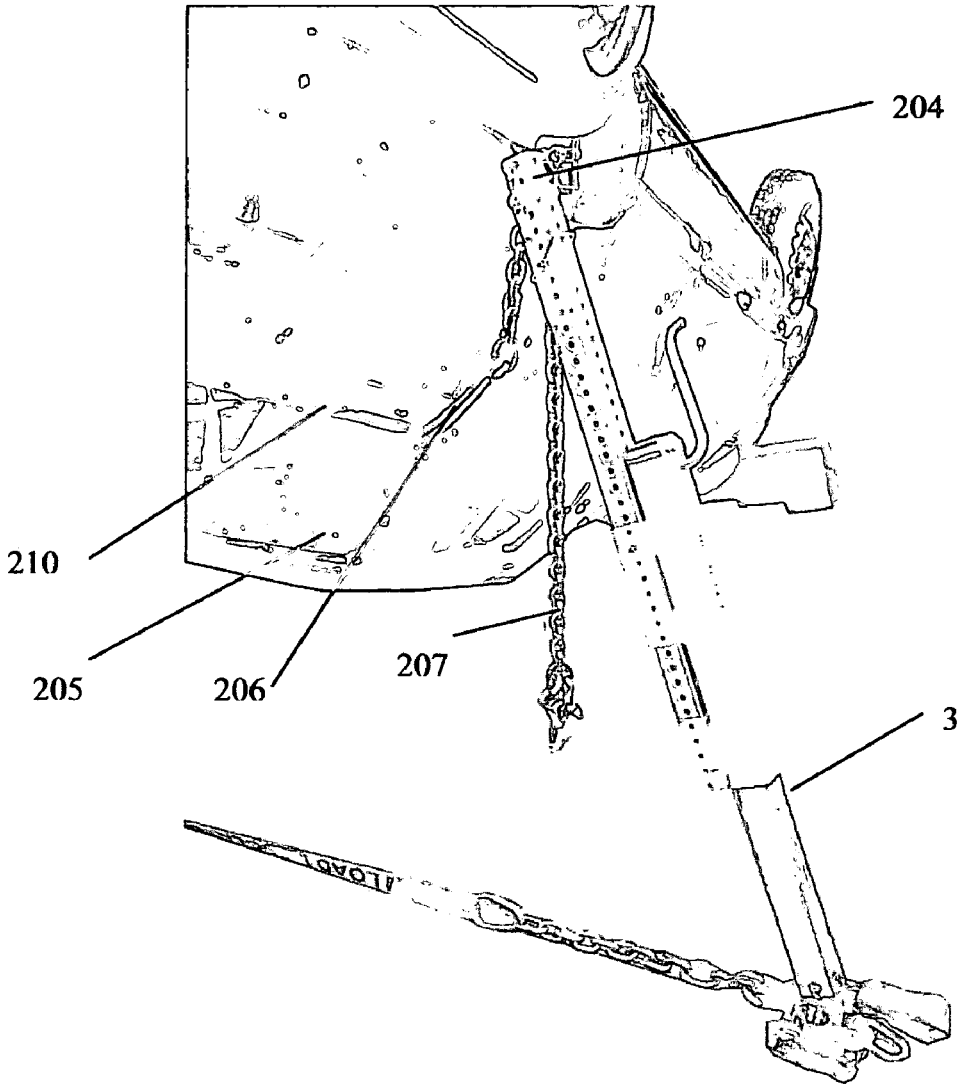
FIG. 22 shows an alternative embodiment according to the invention, including the step of J-hooking the rear deck.

Referring now to FIG. 22, another method is to enter through the rear window (205) of an inverted vehicle and attach a large J-hook (206) to the rear deck (210) or speaker deck. A chain (207) is then attached (if not a chain/J-hook assembly) to the J-hook and brought up the side of the vehicle where it may be engaged by a chain grab type fitting (204) affixed to the buttress stands. This method, in most cases, eliminates the need to secure the chain from slipping off the vehicle. This method also eliminates the need for a chain saddle to pass through the passenger compartment of an SUV, minivan or wagon vehicle. This method also eliminates the need for a chain saddle to pass across the trunk lid of a sedan type vehicle, allowing trunk access. This method also eliminates the need for a chain saddle to pass across the rear window of a hatchback, which is often a critical patient access point. This method also involves fewer components than the standard method. It preferably involves the two buttress stands with chain grab type end fittings, the base to base restraint chain or strap, as well as a J-hook/chain attachment at each post. If lifting or additional stability is desired, one may incorporate the two optional sway prevention straps (201).

Prior art techniques for making a purchase with a vehicle using round pin type or round point end fitting typically involve the use of pre-existing holes or the violent action of piercing a hole. Pre-existing holes in a vehicle provided by the manufacturer are not always readily available or in the needed location. The act of piercing a hole with a tool, such as a Halligan tool, for example, is a violent and loud action, which has the potential to further complicate the accident scene. A pierced hole may also have a tendency to tear under load.

Figure 23A:
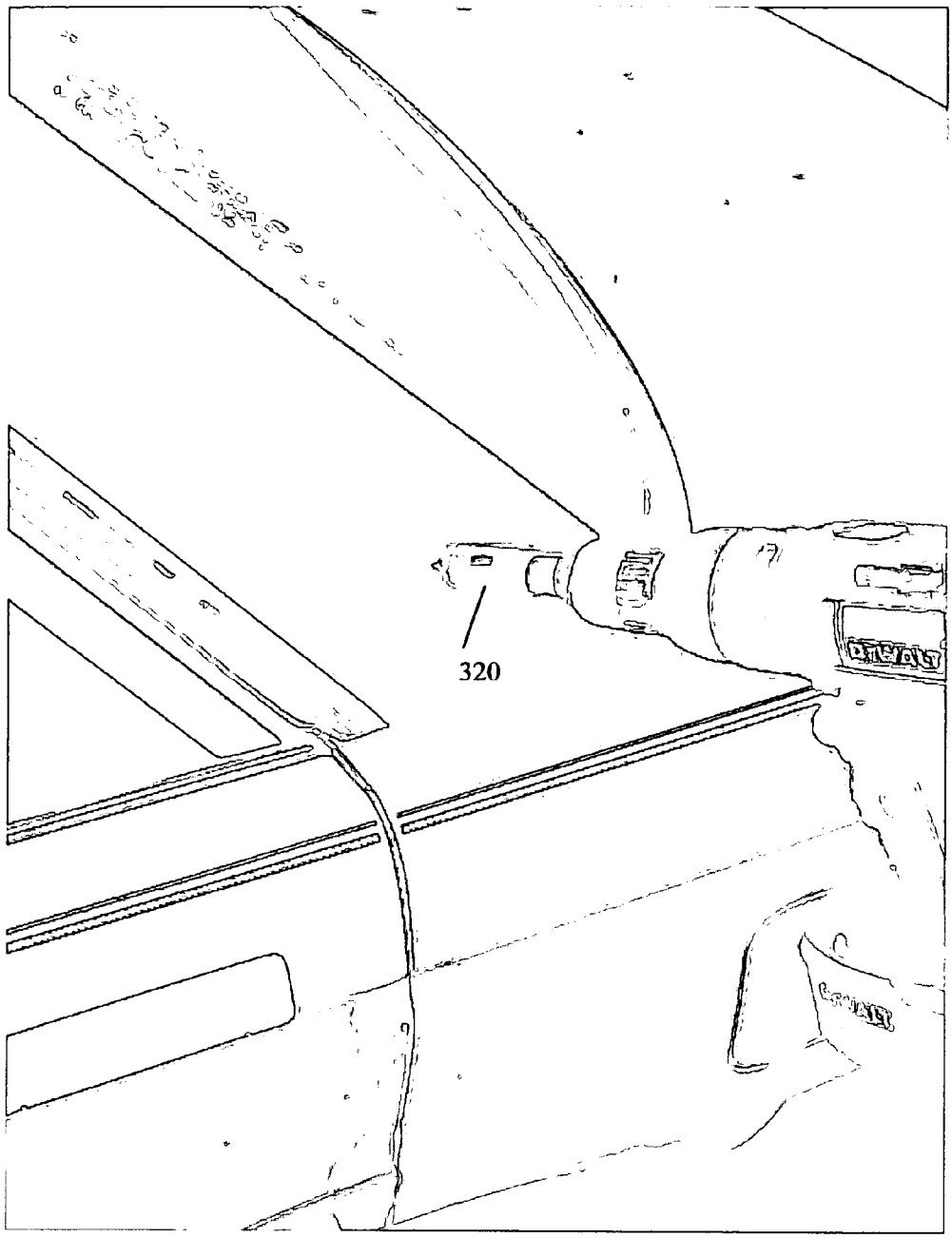
FIGS. 23*a*-23*c* show an alternative embodiment according to the invention, including the step of using a hole saw for creating a purchase point.
Figure 23B:
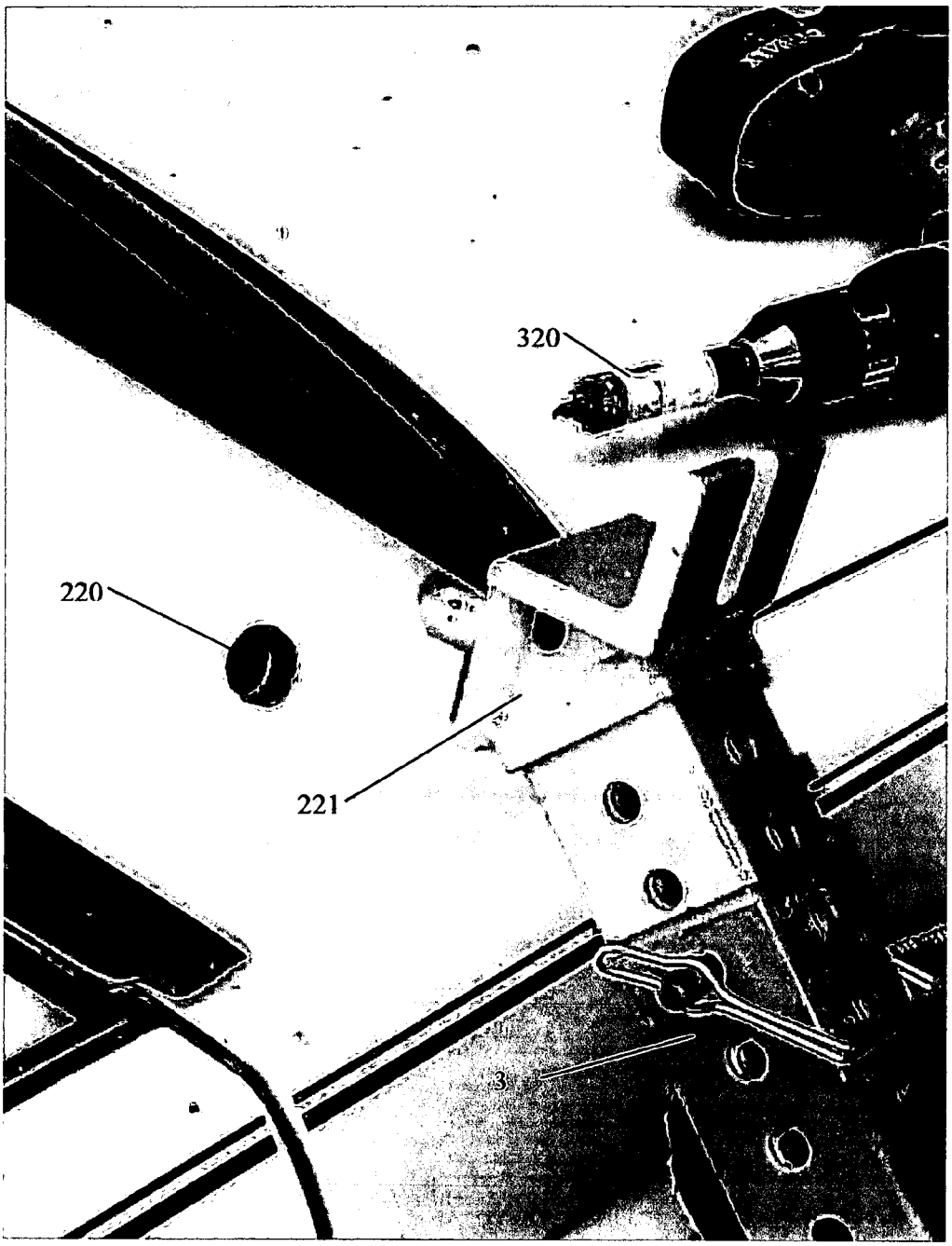
Figure 23C:
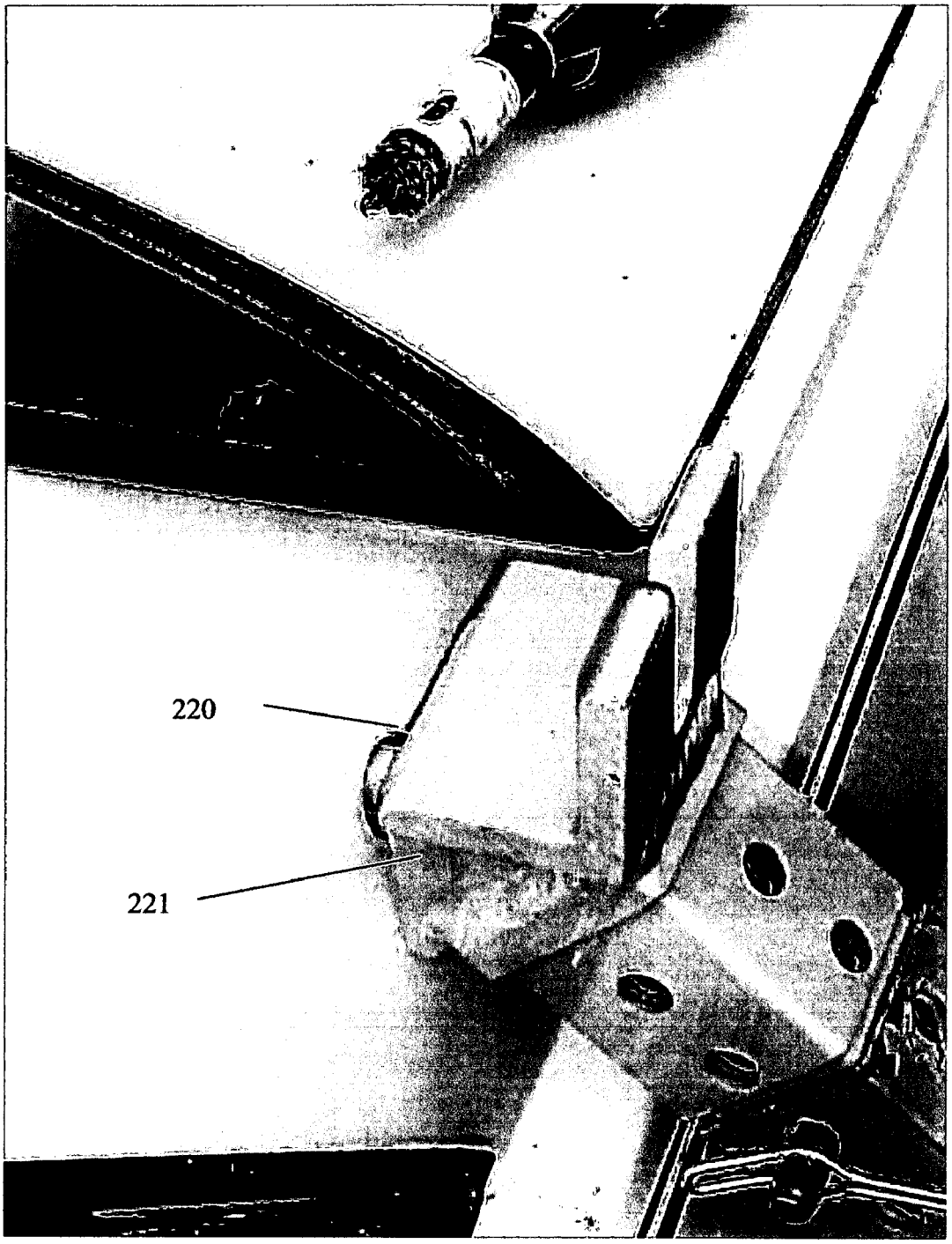

Referring now to FIGS. 23*a*-23*c*, a new method for creating a purchase point where needed in a non-violent fashion and without tearing involves the use of a drill operated hole saw. The hole saw quickly creates a smooth purchase point for a round point end fitting. The method includes the steps of creating purchase holes (220) using a drill-operated hole saw (320) in the desired location. A buttress stand (3) with a round point end fitting (221) is then leaned against the vehicle, with the round point inserted into the hole created by the hole saw. The base of the buttress stand is then attached to the vehicle or alternatively to the opposite buttress stand.

Figure 24A:
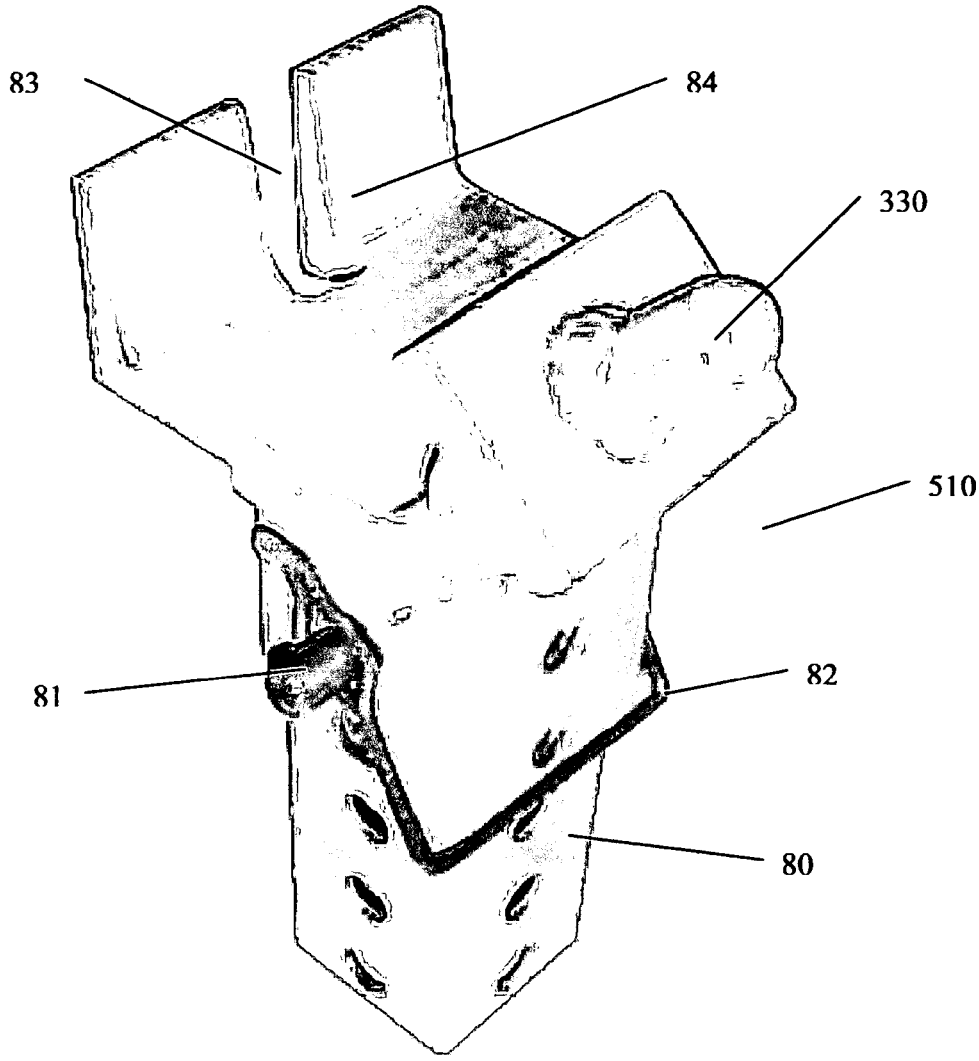
FIG. 24*a* shows a multi-use buttress stand end fitting, according to an embodiment of the invention.
Figure 24B:
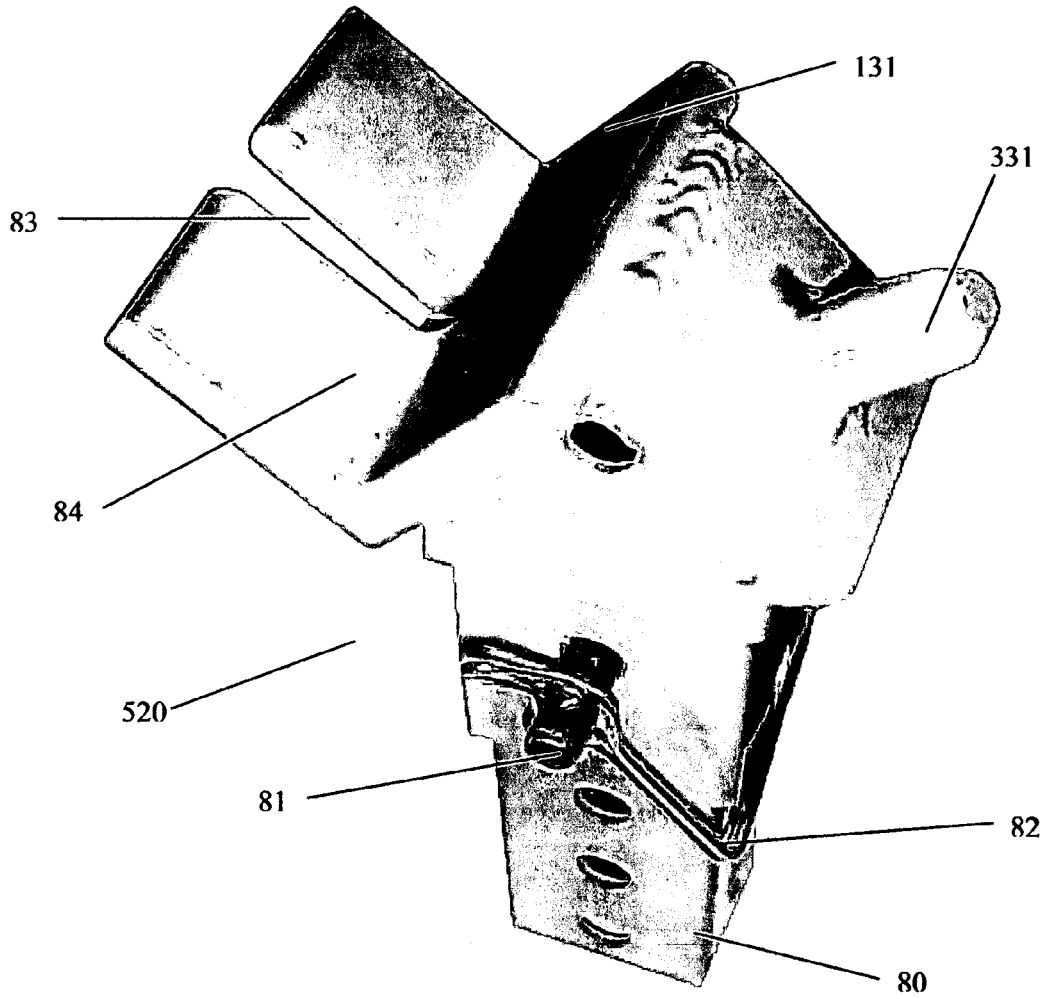
FIG. 24*b* shows a second multi-use buttress stand end fitting, according to an alternative embodiment of the invention.

FIGS. 24*a* and 24*b* show alternative embodiments of two new multi-use buttress stand end fittings (510, 520) incorporating multiple components to maximize versatility. It is desirable to maximize the number of characteristics within a single fitting to avoid the necessity of switching components. The end fitting (510) preferably incorporates a round point (222) for engaging holes, an angle bracket (223) for cradling corners or objects, a protruding lip (224) to engage a recess, and a slot (225) to grip a chain. Optional features include being rotatable, having a lock pin for chain engagement, and means for use with extendible stands or fixed length stands, such as timbers.

Figure 25A:
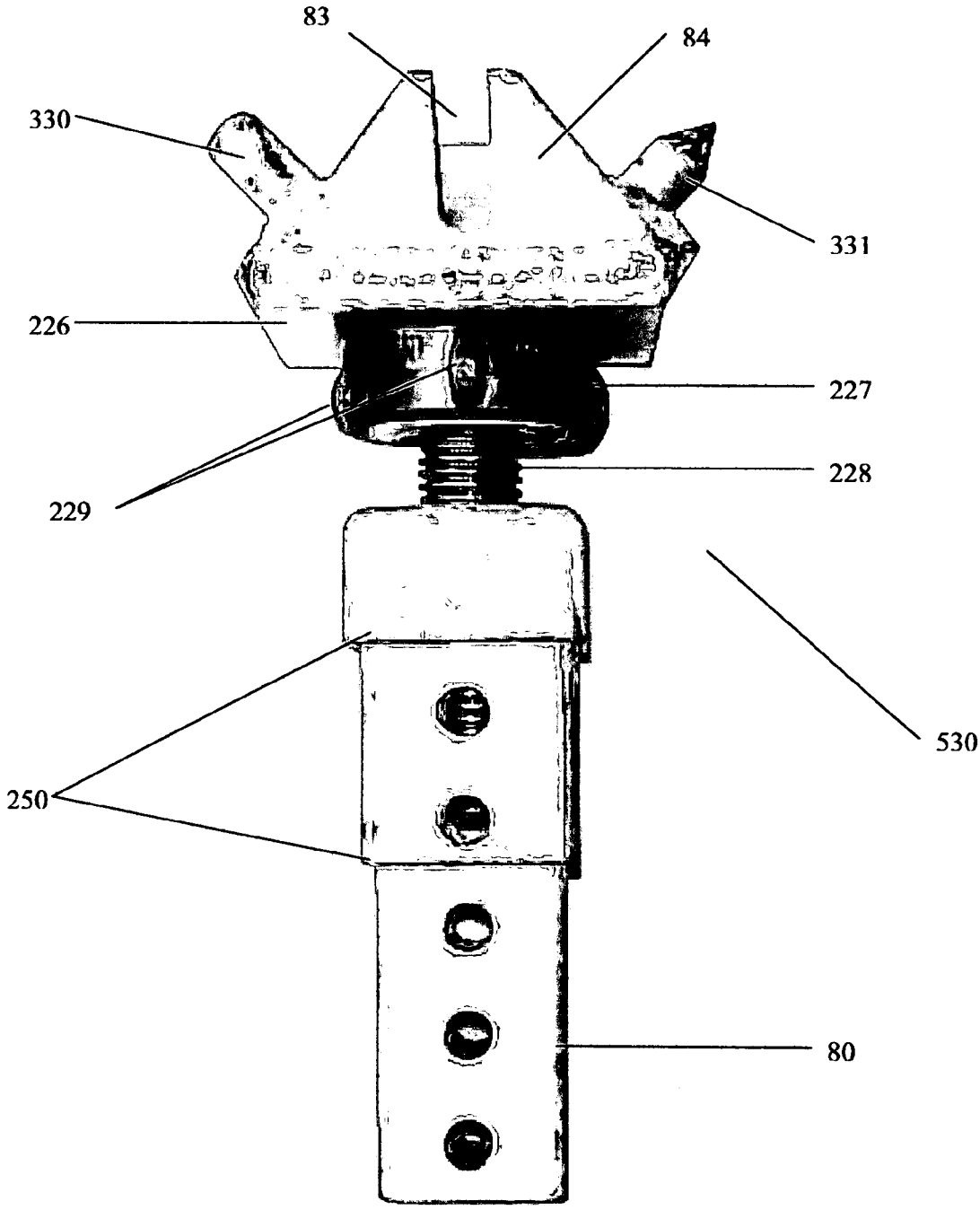
FIGS. 25*a* and 25*b* show two views of a turret head buttress stand end fitting, according to an embodiment of the invention.
Figure 25B:
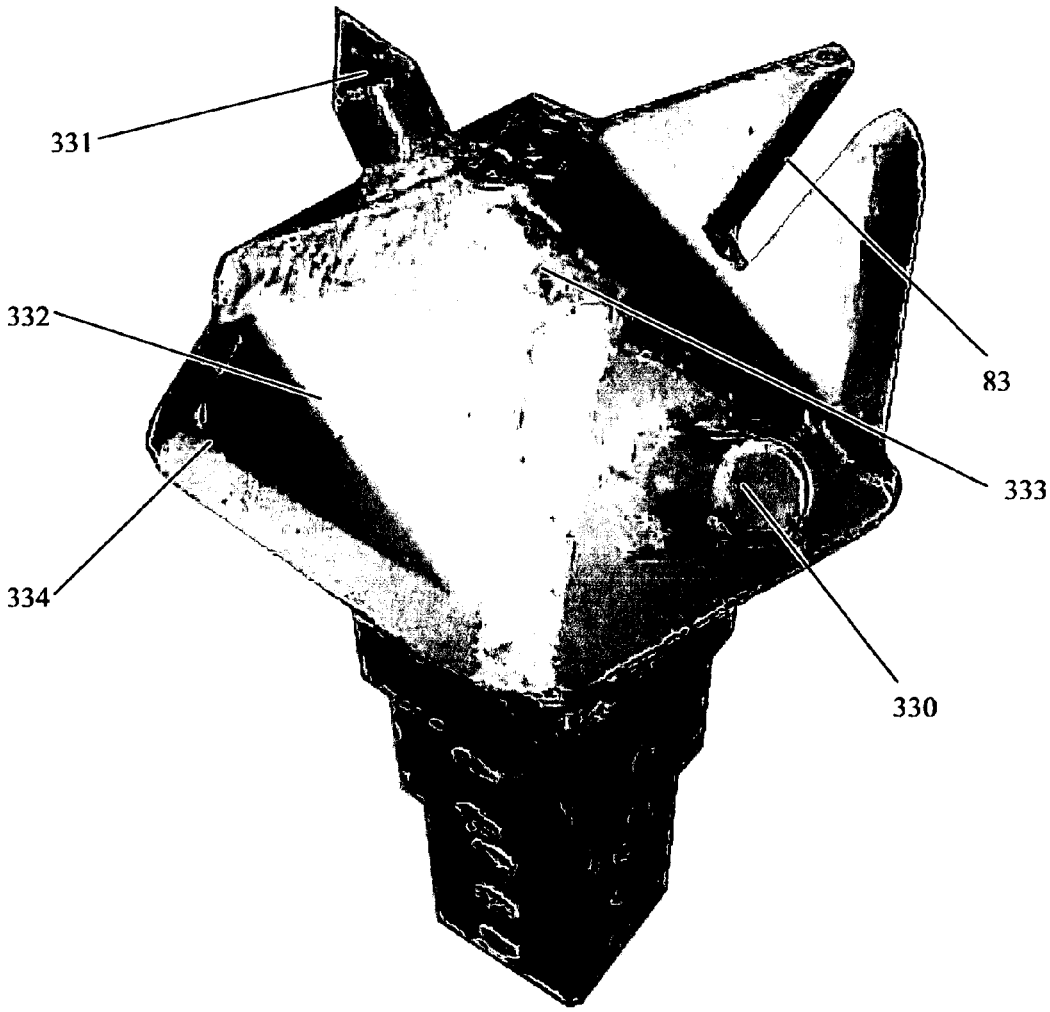

FIG. 25*a* and 25*b* show a new turret head buttress stand end fitting (530). The head (226) raises and lowers by turning the ribbed collar (227) fixed to the threaded jack shaft (228). It has a ribbed or similar means (229) for gripping for use with a spanner wrench or similar means. The top of the head is free to rotate independently of rotation of the jack shaft. The base of the head preferably has a stepped design (250) to allow for insertion in multiple size components. It also optionally includes one or more engagement means, such as a chain slot (83) for chain engagement with or without a locking means, a blunt round pin (330) for engaging holes, a pointed round pin (331) for piercing holes, an angle (332) for cradling corners, a lip (333) for engaging a linear protrusion or a pointed flat protrusion (334) for additional piercing applications. It is designed to work with different stand types and/or wood timbers.

Figure 26:
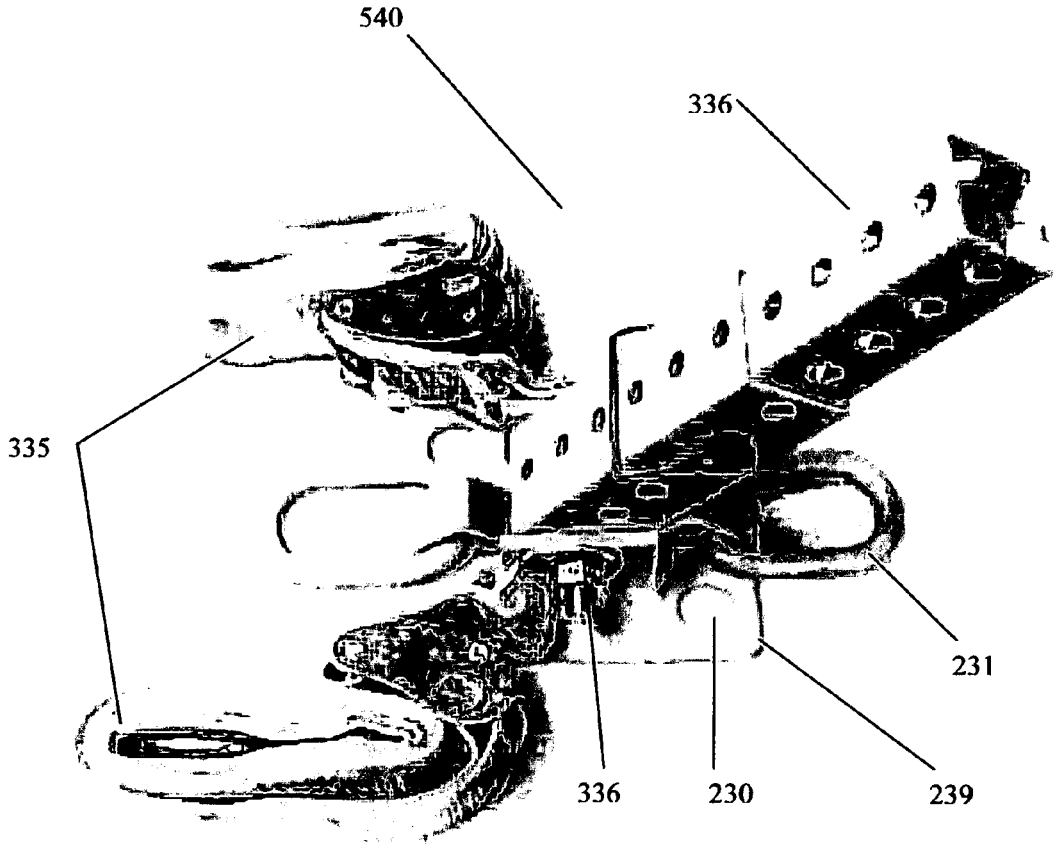
FIG. 26 shows a pivotal buttress stabilization base fitting, according to an embodiment of the invention.

Referring now to FIG. 26, a pivotal buttress stabilization base plate (540) is shown, having multiple components/characteristics to maximize versatility. It is desirable to maximize the number of characteristics within the base plate to accommodate multiple restraint types. The base (239) preferably incorporates round holes (230) for engaging stakes, pre-attached cam buckle straps, ratchet straps, chain, or other flexible members (335), and an attached link (231) for connecting straps, chains, cables, hooks, or similar restraining flexible members. The link optionally accommodates a large stake. Other optional features include pivoting means (336), having an upright post (337) and an anti-skid bottom surface.

Folding Telescopic Buttress Stabilization/Shoring Stand

Figure 27:
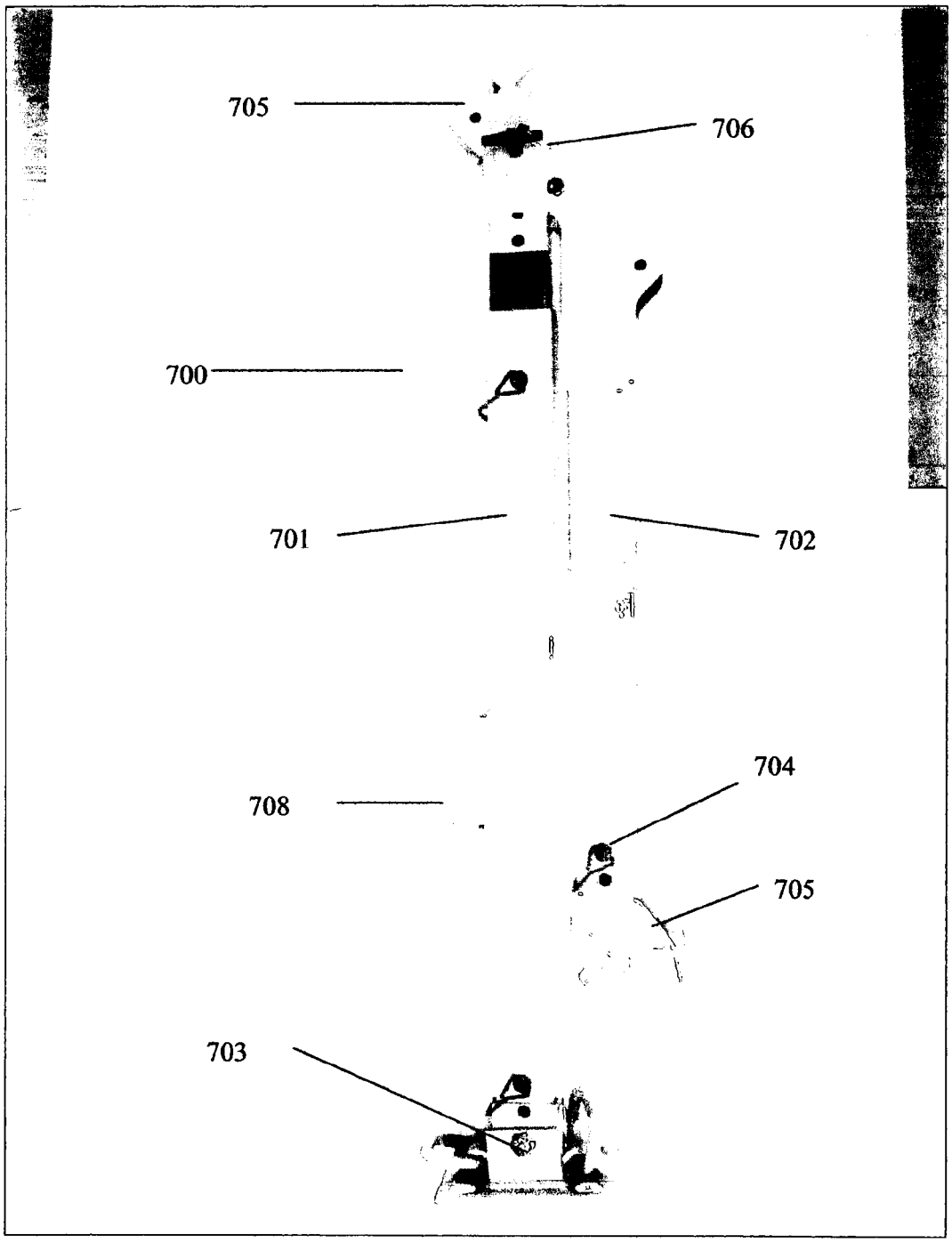
FIG. 27 shows a folding telescopic buttress stabilization stand, according to an embodiment of the invention, in its folded configuration.
Figure 28:
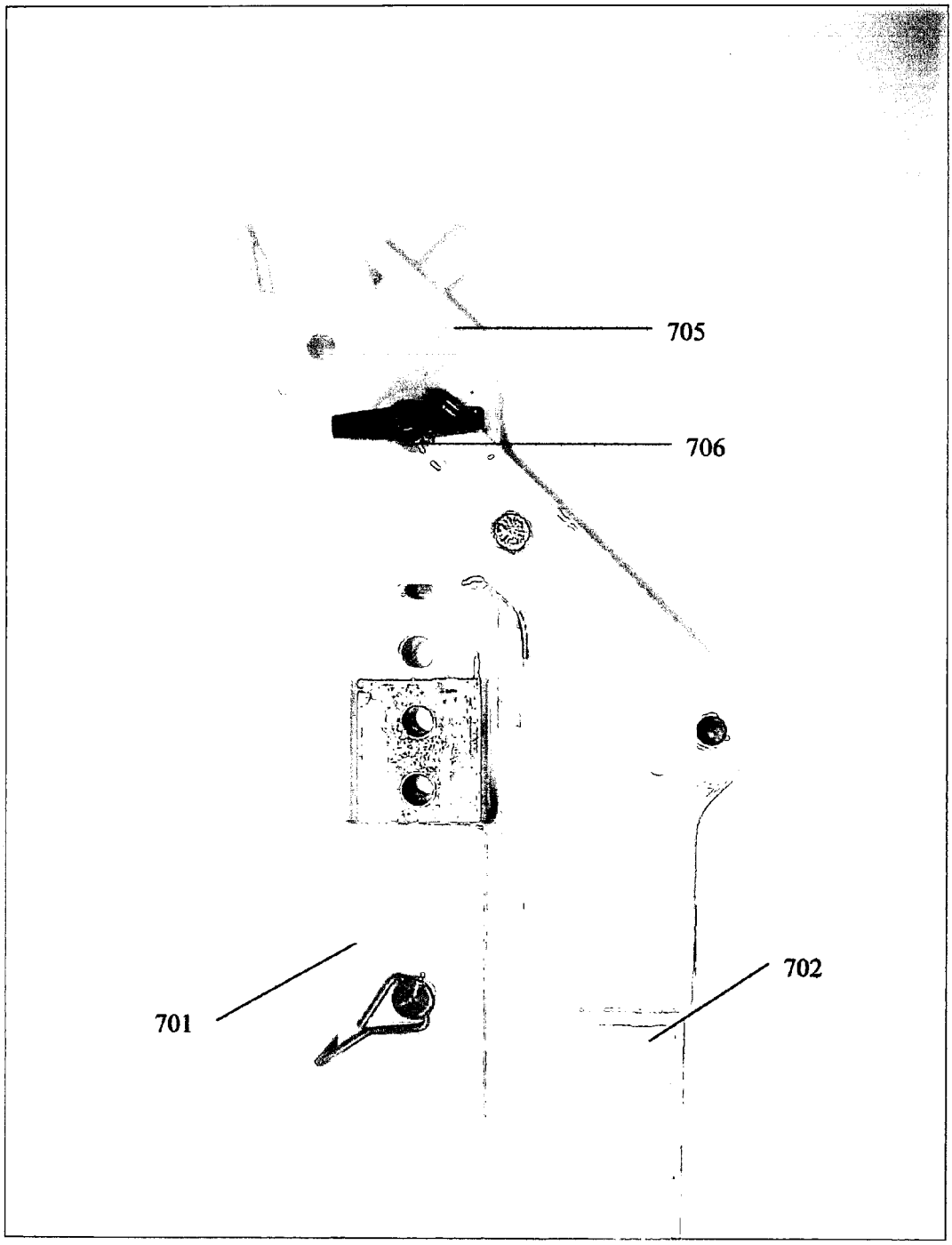
FIG. 28 shows the folding telescopic buttress stabilization stand of FIG. 27, providing a detail view of the hinge section.
Figure 29:
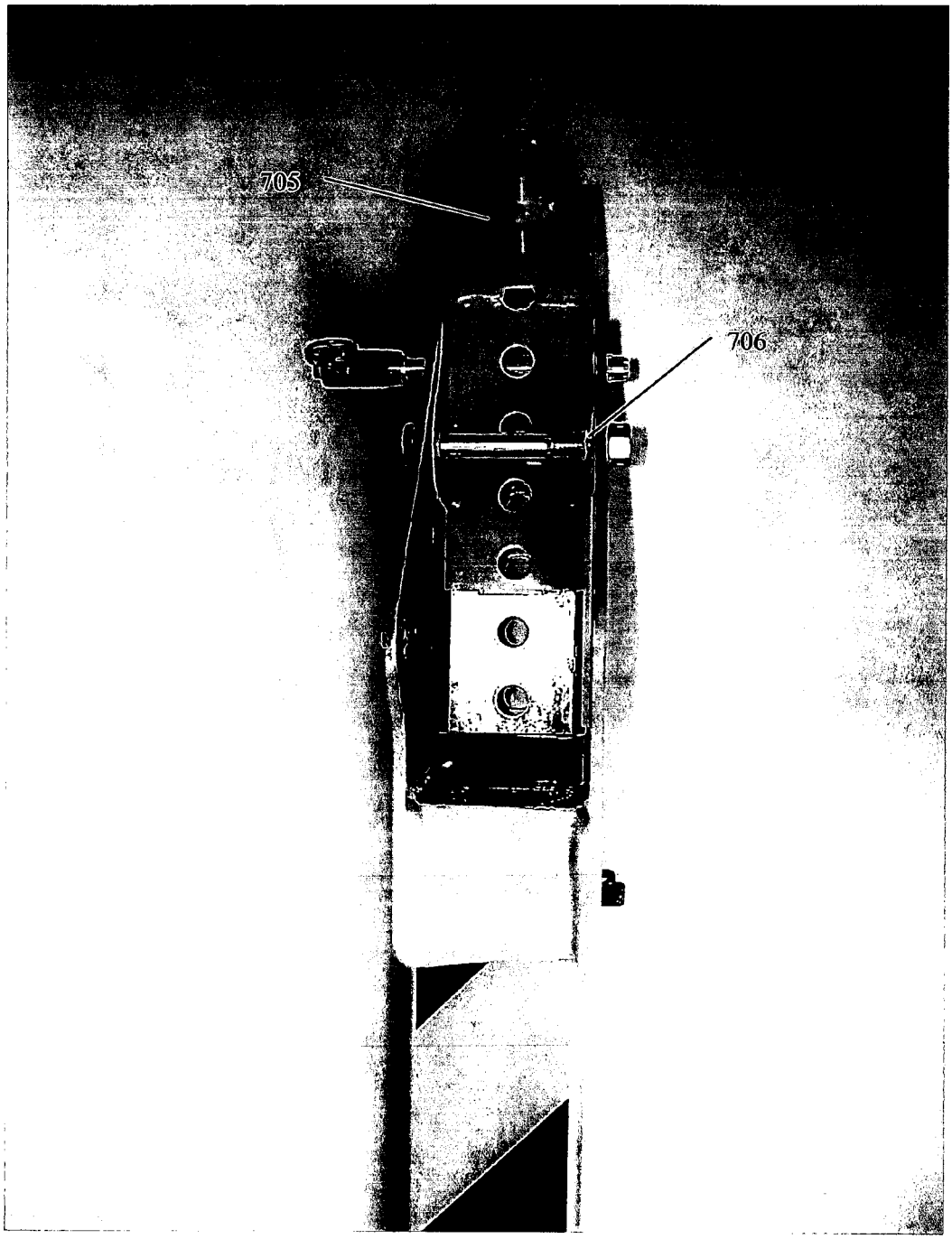
FIG. 29 shows the folding telescopic buttress stabilization stand of FIG. 27, providing an alternative detail view of the hinge section.
Figure 30:
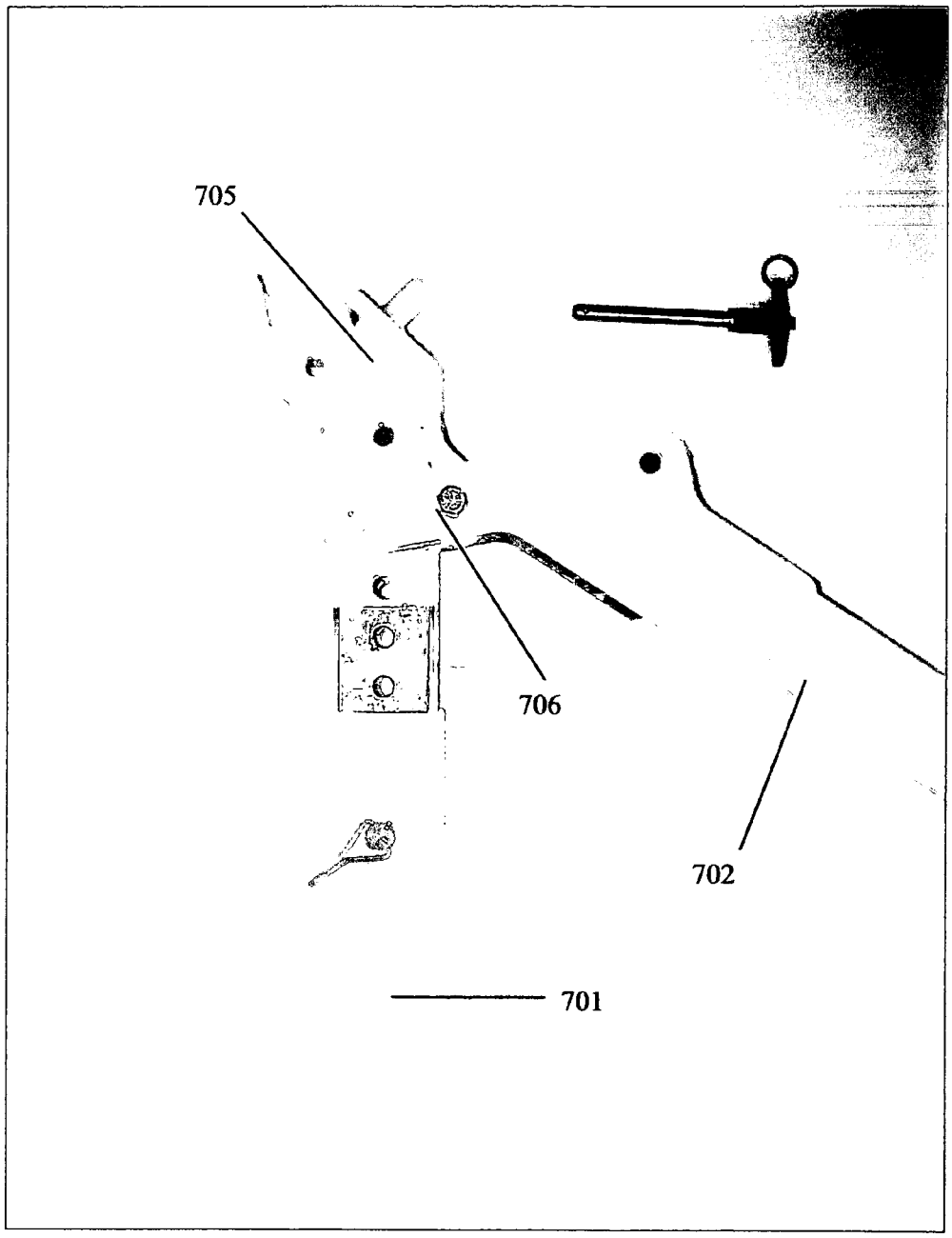
FIG. 30 shows the folding telescopic buttress stabilization stand of FIG. 27, providing a detail view of the hinge section in a partially unfolded configuration.
Figure 31:
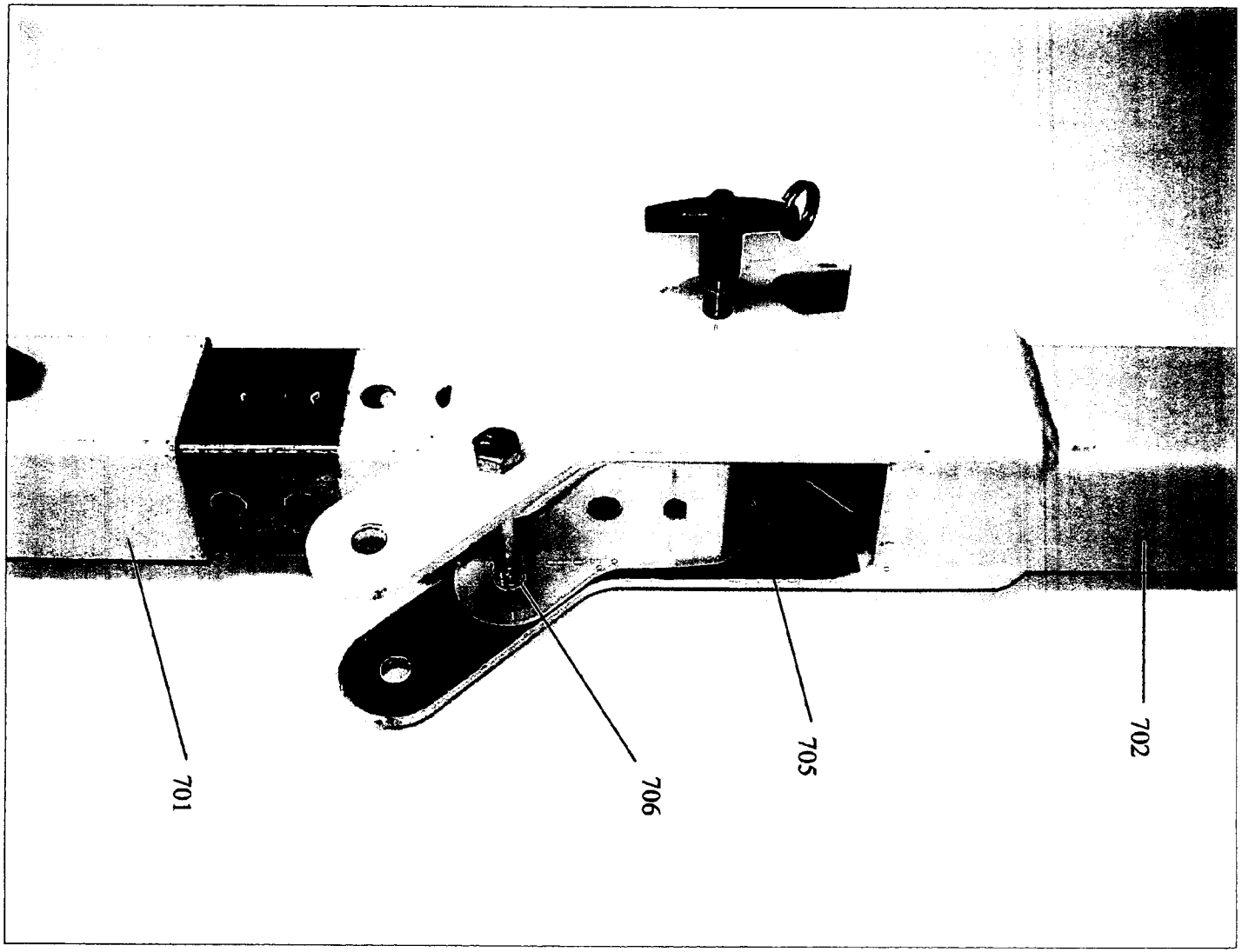
FIG. 31 shows the folding telescopic buttress stabilization stand of FIG. 27, providing a detail view of the hinge section in the fully unfolded configuration.
Figure 32:
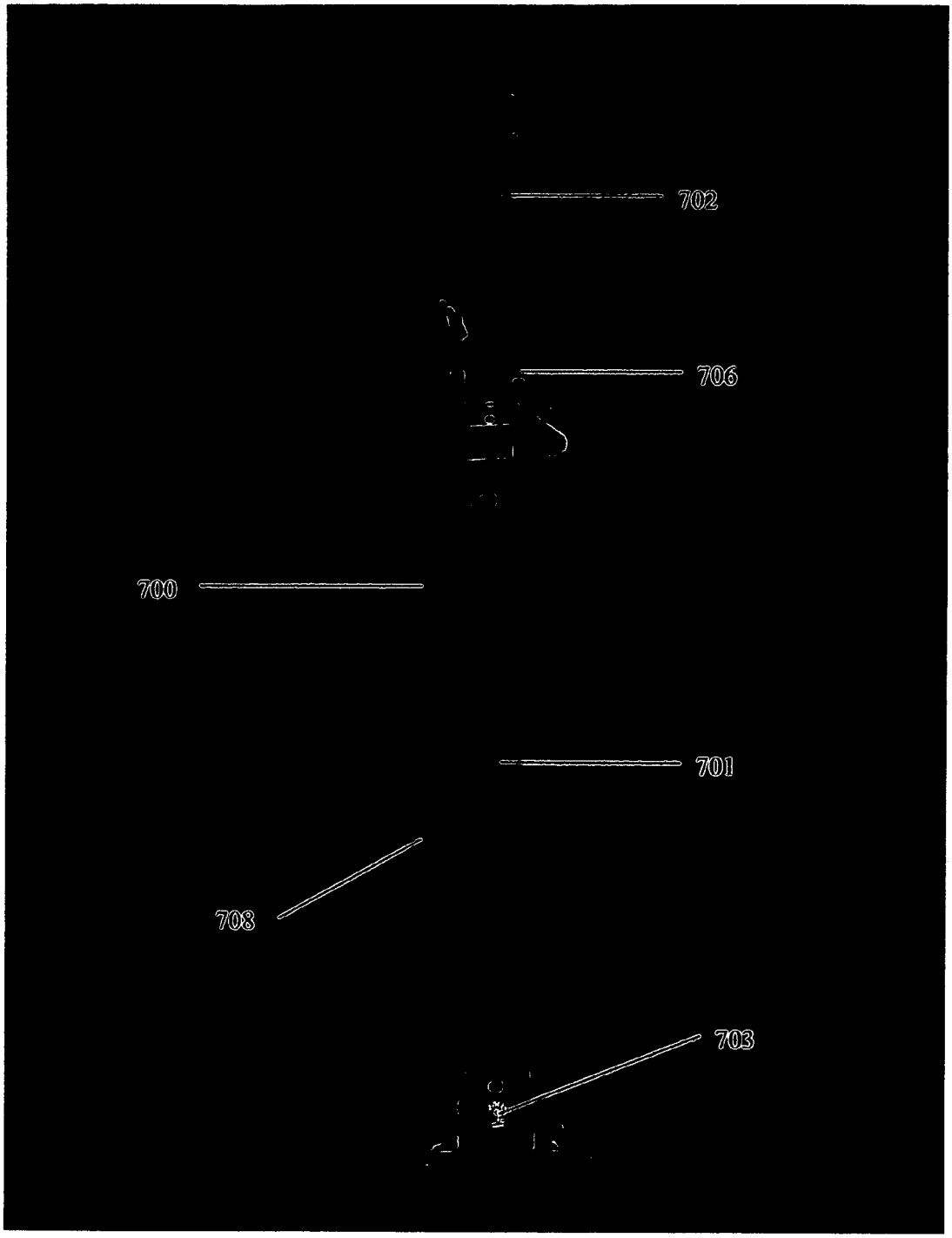
FIG. 32 shows the folding telescopic buttress stabilization stand of FIG. 27, in the unfolded configuration.
Figure 33:
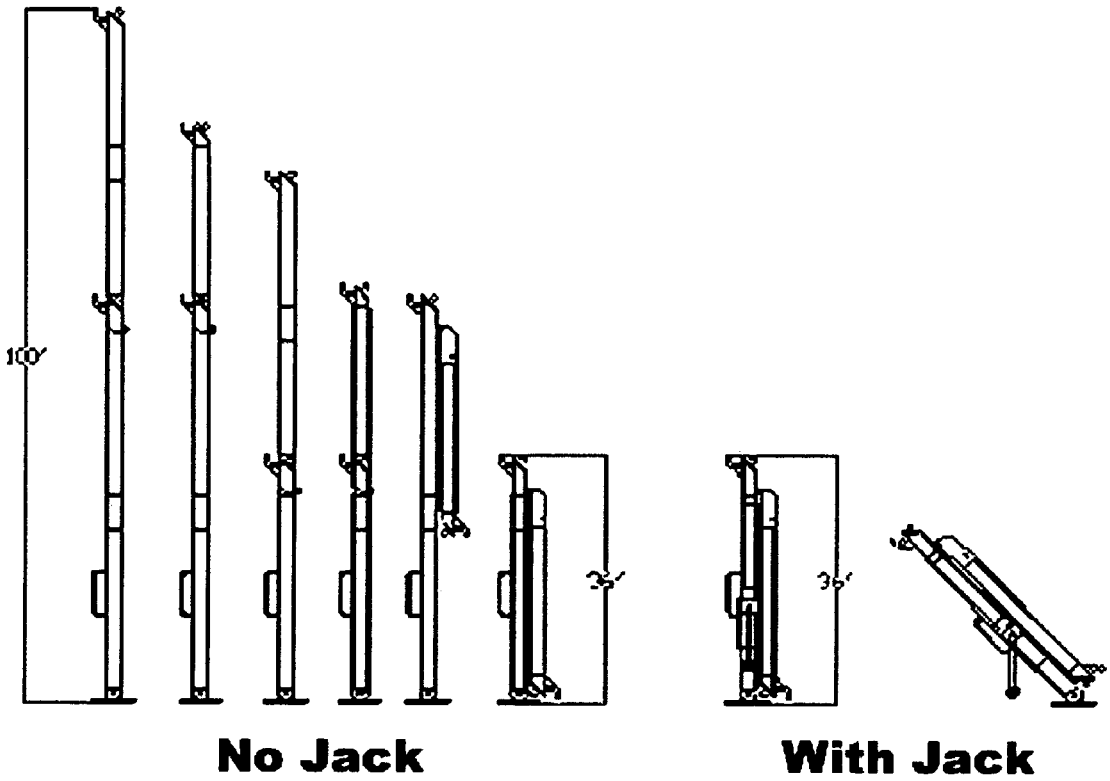
FIG. 33 shows various alternative embodiments of a folding telescopic buttress stabilization stand, according to the invention, some of which include a jack.

Referring now to FIG. 27, one embodiment of a folding telescopic stabilization/shoring/ram or support device (700) is shown, including a first two-piece telescopic section (701) pivotally attached at its lower end to a base plate (703), and pivotally attached at its upper end to a second two-piece telescopic section (702). Note that two-piece telescopic sections are preferable, due to simplicity of operation, however, more or less sections are deemed to be within the scope of the invention, or one of the sections can be non-telescopic. The hinge connection allows the stand to be folded, thus making for a more compact tool upon storage or transport. Each two-piece section independently telescopes by pulling a single pin (704) at each section. This embodiment includes a base pivotally attached to the lower outer tube. The base optionally is removable. The lower inner tube is slidably attached inside the lower outer tube. An end fitting (705) or adapter for engagement with a vehicle, structure, or other objects is fixed to the top of the lower inner tube. The end fitting optionally is removable. A base and end fitting optionally are interchangeable. The base and/or end fitting optionally are rotatable. A hinge (706) at the top of the lower inner tube just below the end fitting connects the lower (first) telescopic section (701) with a similar upper (second) telescopic section (702). The upper (second) telescopic section remains folded down adjacent to the lower section, unless and until the full extension of the lower (first) section is not sufficient to reach the desired purchase height. In that case, the upper section is pivoted up in line with the lower section, where locks by means of a pin or preferably a self-engaging means. The inner tube of this section may also be extended now to reach greater heights. The top of the upper inner tube preferably includes the same end fitting (705) as the top of the lower inner tube. In an alternative embodiment, the upper section can be detached from the lower section, resulting in two relatively short stands. In yet another alternative embodiment, three or more such sections or stands are attached together in like manner, resulting in a zigzag fold pattern.

In the folded configuration, the two sections are slidably attached to each other, such that the folded upper section does not freely swing at the hinge point, but slides up and down along the lower section to allow for telescopic adjustment of the lower section. Additionally, the upper section can be detached from the lower section at the hinge point to create two independent short stands. Optionally a carrying handle (708) is attached. The inner and outer tubes optionally include stop collars, which prevent unsafe extension of the sections.

Over-extension Prevention for Telescopic Stand.

In lieu of stop collars, an improved means for preventing over-extension of a telescopic buttress stabilization stand includes a connecting rod or similar rigid member, or a cable or similar flexible connection attached to or near the base and run up through the inside of the outer and inner tube or tubes. The top of this rod includes a J-shaped hook or other catch means for stopping extension of the inner tube or tube. The hook or catch means engages a cross member fixed to the lower end of the inside tube, or other means for catching the connecting member to prevent over extension.

In a buttress stabilization stand comprising square perforated tubing, one problem is that a rigid connecting rod running up through the center could interfere with pinning successive sections to secure the telescopic tubing members. One means to circumvent this problem includes adding a rigid connecting member which positions the rod in the corner of the inside tube or tubes. A flexible connecting member, however, will readily move aside, when pinning through the perforations to secure the telescopic tubing members.

An alternative embodiment includes an inner tube or tubes containing an open slot along the entire length, with the exception of a length near the end determined by the overlap requirement. The outer tube includes a pin or similar component, which slides freely along the inner tube slot. Once minimum overlap is achieved, the pin contacts the end of the slot, preventing further extension. The pin optionally is rigidly fixed, spring loaded, removable, or otherwise attached and activated. Likewise, the slot optionally is located within the outer tube or tubes and the stop pin on the inner tube or tubes.

Accordingly, it is to be understood that the embodiments of the invention herein described are merely illustrative of the application of the principles of the invention Reference herein to details of the illustrated embodiments is not intended to limit the scope of the claims, which themselves recite those features regarded as essential to the invention.

What is claimed is:

1. A method for stabilizing a vehicle in an unstable position, comprising the steps of:

a) leaning a first buttress stand and a second buttress stand against a right fender area and a left fender area at an end of said vehicle, each buttress stand having a base, an end fitting, and a length therebetween, the buttress stands being arranged with the end fitting nearest the vehicle and the base on the ground, spaced outwardly from the vehicle;

b) restraining the buttress stand bases from sliding;

c) securing the vehicle using a technique selected from the group consisting of i) wrapping a flexible tie member around at least one rear post of the vehicle;

ii) entering through a rear window opening of an inverted vehicle and attaching a J-hook to at least one rear post of the vehicle, the J-hook having a flexible tie member attached thereto;

iii) entering through a side window opening of an inverted vehicle and attaching a J-hook to at least one sidewall of the vehicle, the J-hook having a flexible tie member attached thereto; and iv) entering through a rear window opening of an inverted vehicle and attaching a J-hook to a rear deck or speaker deck of the vehicle, the J-hook having a flexible tie member attached thereto; and d) passing an opposite end of the flexible tie member up or across the side of the vehicle, where it is engaged with the fitting affixed to the buttress stand;

wherein the step of leaning a first buttress stand and a second buttress stand includes providing at least one buttress stand having at least one hinge between two adjacent tubular members thereof.

2. The method of claim 1, wherein the step of leaning a first buttress stand and a second buttress stand includes providing at least one folding telescopic buttress stand, comprising:

a first two-piece telescopic section having an outer tubing member and an inner tubing member in slidable engagement, said outer tubing member being pivotally attached at a lower end thereof to a base plate, and said inner tubing member having attached at an upper end thereof a second two-piece telescopic section having an outer tubing member and an inner tubing member in slidable engagement.

3. The method of claim 2, wherein said folding telescopic buttress stand comprises an end fitting or adapter for engagement with a vehicle or other object affixed to an upper end of said inner tubing member.

4. The method of claim 3, wherein said folding telescopic buttress stand comprises a third two-piece telescopic section having an outer tubing member and an inner tubing member in slidable engagement affixed to an upper end of said second two-piece telescopic section.

5. A method for stabilizing a vehicle in an unstable position, comprising the steps of:

a) leaning a first buttress stand and a second buttress stand against a right fender area and a left fender area at an end of said vehicle, each buttress stand having a base, an end fitting, and a length therebetween, the buttress stands being arranged with the end fitting nearest the vehicle and the base on the ground, spaced outwardly from the vehicle;

b) restraining the buttress stand bases from sliding;

c) securing the vehicle using a technique selected from the group consisting of i) wrapping a flexible tie member around at least one rear post of the vehicle;

ii) entering through a rear window opening of an inverted vehicle and attaching a J-hook to at least one rear post of the vehicle, the J-hook having a flexible tie member attached thereto;

iii) entering through a side window opening of an inverted vehicle and attaching a J-hook to at least one sidewall of the vehicle, the J-hook having a flexible tie member attached thereto; and iv) entering through a rear window opening of an inverted vehicle and attaching a J-hook to a rear deck or speaker deck of the vehicle, the J-hook having a flexible tie member attached thereto; and d) passing an opposite end of the flexible tie member up or across the side of the vehicle, where it is engaged with the fitting affixed to the buttress stand; and wherein the step of leaning a first buttress stand and a second buttress stand includes providing at least one buttress stand that includes at least one means for preventing overextension of a telescopic tubular member thereof.

* * * * *